US008695778B2

(12) United States Patent
Clauser et al.

(10) Patent No.: US 8,695,778 B2
(45) **Date of Patent: *Apr. 15, 2014**

(54) MODULAR SECURITY GATE

(71) Applicant: MEI, Inc., Malvern, PA (US)

(72) Inventors: Robert J. Clauser, Columbus, NJ (US); Michael D. Nunn, West Chester, PA (US); Karen Marvin, Pottstown, PA (US)

(73) Assignee: MEI, Inc., Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/737,343

(22) Filed: Jan. 9, 2013

(65) Prior Publication Data

US 2013/0180821 A1 Jul. 18, 2013

Related U.S. Application Data

(60) Provisional application No. 61/586,100, filed on Jan. 12, 2012.

(51) Int. Cl.
*G07F 1/00* (2006.01)
*G07F 1/02* (2006.01)

(52) U.S. Cl.
USPC ..... 194/351; 194/203; 194/349

(58) Field of Classification Search
USPC ..... 194/202, 203, 344, 349, 351; 235/1 A, 235/24; 49/35, 425; 109/58, 58.5, 59 T, 64, 109/66, 73
See application file for complete search history.

(56) References Cited

U.S. PATENT DOCUMENTS 6,991,083 B2 * 1/2006 Yoshioka et al. ..... 194/346

* cited by examiner

*Primary Examiner* — Mark Beauchaine
(74) *Attorney, Agent, or Firm* — Mintz Levin Cohn Ferris Glovsky and Popeo, P.C.

(57) ABSTRACT

Apparatus for preventing unauthorized removal of currency items from a currency handling apparatus is provided. A removable security gate mechanism (500) is provided that comprises a housing (501), a rotatable gate (510), a drive wheel and a positioning member. The positioning member is selectively engageable with the drive wheel for positioning the rotatable gate (510).

19 Claims, 28 Drawing Sheets

MODULAR SECURITY GATE

RELATED APPLICATIONS

This application claims priority to U.S. Provisional Application No. 61/586,100, filed Jan. 12, 2012, the content of which is hereby expressly incorporated by reference.

FIELD OF DISCLOSURE

The disclosure relates to a device for preventing unauthorized removal of currency items from a currency handling apparatus. More particularly, the disclosure relates to a removable security gate device to prevent removal of currency items from within a currency handling apparatus.

BACKGROUND

Various machines and devices are known for accepting items of currency in exchange for goods and services. In devices that accept items of currency there is often a validation component for determining type, validity and authenticity of the inserted currency, for example a bill validator as known in the art. An example of a bill validator is disclosed in U.S. Pat. No. 6,712,352, which is expressly incorporated herein by reference in its entirety. In some devices, there is a need to store the accepted currency that has been determined to be valid within the machine for either collection at a later time or for dispensing as part of a subsequent transaction. Storage of acceptable currency often takes the form of a cashbox or currency storage container.

When a machine or device stores currency, there are often concerns with the security and accessibility of the stored currency to prevent theft. Various measures have been developed to minimize theft from such storage areas for example, locks or tamper evident markers. Systems have also been developed to prevent extraction of an item of currency, for example a bill or banknote, once the machine has issued credit for the inserted bill.

An example of a system for preventing the extraction of a bill from a bill validation device is disclosed in U.S. Pat. No. 5,577,589. The system disclosed in U.S. Pat. No. 5,577,589 utilizes a rotatable type gate to prevent a user from extracting an accepted banknote from a machine using a string attached thereto. Particularly, once the bill validator has accepted the banknote, a user may attempt to extract the accepted banknote using the attached string. However, the rotatable gate can be actuated so as to block the transportation path and thus prevent extraction of the banknote. This is often called string fraud. Actual string can be used as well as other thin flexible items such as wire, film, tape, etc. the disclosure herein is not limited to string-fraud.

Another example of a device to prevent the extraction of a banknote from a bill validator using a rotatable gate is disclosed in U.S. Pat. No. 6,179,110. The device disclosed in U.S. Pat. No. 6,179,110 utilizes a rotatable type gate positioned along the transport path of a banknote validator. In particular, the disclosed device has a driving device for rotatable the rotatable gate from a position allowing passage of a banknote there through to at least one position preventing passage of a banknote along the transportation path. Other features of the device disclosed in the foregoing patent include a bill validator with a rotator and driving device of the rotator which can be prevented from being damaged by inertial force of the rotator motor when the rotator is stopped in a position.

A disadvantage of the above devices, is that each is affixed within and forms an integral component of a currency handling device. Due to the intended function of a security gate device disclosed by the above devices, when a string fraud attempt is made, often the attached string will be wound around the rotating gate and thus disabling the currency handling unit. In order to enable the currency handling unit for subsequent operation, the currency handling unit must be serviced. This service often requires complicated disassembly and repair of the currency handling unit as a whole. Such a situation is undesirable.

Therefore there exists a need for a removable security gate mechanism that is capable of being easily replaced within a currency handling apparatus to lower costs and reduce device down time.

In environments where previously installed bill validators (i.e. bill validators without a gate security system) exist and there is need for an anti-string fraud system, rather than the complicated and expensive replacement of the entire currency handling systems as currently required. The expense and logistics involved with such a replacement initiative renders such a solution impractical.

Therefore there exists a need for a retrofittable security gate mechanism so as to be able to be installed to existing field based currency handling units.

SUMMARY

Various aspects of the invention are set forth in the claims.

The disclosure relates to a currency handling apparatus. For the purposes of the disclosure currency includes, but is not limited to, bills, banknotes, security papers, documents, sheets, coins, tokens, certificates or coupons. The currency handling apparatus of the disclosure includes a passageway through which currency travels within the device. In some implementations, the passageway begins at an inlet where currency is inserted into the device, a validation section, and an outlet. In some implementations, the inlet and outlet can be the same opening. In some implementations, the currency handling apparatus includes a validation component, and a currency storage component. The validation component can include sensors for determining the type and validity of an inserted item of currency.

The validation component can be arranged to sense various features or aspects of an inserted currency item as commonly known in the arts, for example reflection and/or transmission of light from a banknote. Other forms of validation techniques are contemplated, but are not explained in detail as they do not constitute the inventive aspect of the invention and are commonly known in the arts.

The storage component can take the form of a cashbox as commonly known in the arts. In some implementations, the cashbox is a removable container arranged to store a plurality of items of currency (e.g. stacked banknotes) in an enclosure. The storage component can include a stacking mechanism integrated within the storage component for stacking currency therein. However, such a stacking mechanism need not be integrated into the cashbox itself in order to fall within the scope of the disclosure. In an implementation of the disclosure the plurality of stored currency is arranged within the storage component in a stacked (i.e. a face to face) relationship, however the currency may be stored within the storage component in other manners such as in bulk or wound around a storage drum.

The currency handling device further includes a security gate mechanism operable to prevent unauthorized extraction (or removal) of an inserted currency item from within the device. The security gate includes a rotatable gate structure operatively coupled to a drive wheel for actuating the rotatable gate. In some implementations, the drive wheel is drivingly coupled to the rotatable gate by a driving gear having teeth meshingly engaged with teeth formed on the rotatable gate. In other implementations the drive wheel is drivingly engaged with the rotatable gate by other driving means, for example a drive wheel, roller or belt.

The drive wheel is arranged so as to be capable of driving the rotatable gate in a first direction (e.g. clockwise) or a second direction (e.g. counterclockwise) or both. In some implementations the drive wheel is arranged to be coupled to the actuation mechanism of the stacker mechanism. In such an implementation the rotatable gate is actuated by the drive wheel when the stacker mechanism is actuated. In other implementations the drive wheel is an independent component and is controlled to perform the necessary functions of the security gate mechanism.

The rotatable gate includes a slit formed that is aligned with the passageway of the currency handling device when the rotatable gate is in an initial position. The slit in the rotatable gate is configured so as to be capable of allowing items of currency to travel through the rotatable gate when in the initial position. In some implementations, the slit formed in the rotatable gate is of certain dimension so that a banknote can pass there through; however, other dimensions and configurations can be used as well.

In some implementations, the security gate mechanism includes a positioning member selectively engagable with the drive wheel for positioning the rotatable gate in the initial position. In some implementations the positioning member is slidingly moveable between a blocking position and a non blocking position. The positioning member can be biased in a direction urging contact between the drive wheel and the positioning member. In other implementations the positioning member can be pivotally movable between a blocking position and a non-blocking position. In some implementations the drive wheel can include an engaging surface for engagement with the positioning member. In some implementations the engaging surface is a variable cam surface having an abutment surface for engaging the positioning member such that the rotatable gate can be positioned in an initial position.

In some implementations, the security gate mechanism includes a housing, a rotatable gate having a slit therein and coupled to the housing, wherein the slit is aligned with the currency passageway when the rotatable gate is in an initial position, a drive wheel coupled to the housing and further coupled to the rotatable gate, wherein the drive wheel is configured to drive the rotatable gate in first and second directions, the second direction being opposite the first direction, a positioning member coupled to the housing and selectively engageable with the drive wheel for positioning the rotatable gate in the initial position such that the slit in the rotatable gate is substantially aligned with the currency passageway, wherein the positioning member is configured to be engageable with the drive wheel for rotating the rotatable gate in the second direction and not engageable with the drive wheel when the drive wheel rotates the rotatable gate in the first direction. In some implementations, the positioning member is moved from a blocking position to a non-blocking position when the drive wheel is rotated in the first direction.

The security gate mechanism can be configured so as to allow the rotatable gate to rotate in a first direction (e.g. clockwise) while the positioning member slidingly moves along a cam type engagement surface. As the security gate mechanism is actuated, the rotatable gate continues to rotate in a first direction. In some implementations the actuation of the security gate can cause the rotatable gate to move through multiple full rotations or a portion of a full rotation. As the rotatable gate rotates in a first direction, the positioning member is displaced between a blocking position and a non-blocking position and back to a blocking position.

In some implementations the rotatable gate further includes a sensing feature formed on the peripheral edge and operatively engagable with a sensing mechanism. In some implementations the sensing feature is configured as a recess at a periphery of the rotatable gate. In other implementations, the sensing feature is configured as a protrusion at a periphery of the rotatable gate. The sensing feature coupled with the sensing mechanism allows for the position of the rotatable gate to be measured and or monitored.

In some implementations, the security gate mechanism can include a position sensing system for monitoring and determining the position of rotatable gate. In some implementations, such a sensing system includes a light configured to receive light from a light emitting component and second end for transmitting the received light to a detector whereby the position of the rotatable gate can be assessed based upon the known configuration of the rotatable gate and the light pattern detected.

In some implementations the sensing mechanism includes a sliding member operatively coupled to the rotatable gate. The sliding member can include a sensor coupling member (e.g. a prism) operatively coupled to a sensor for sensing the position of the sliding member, and thus sensing whether the rotatable gate is in the initial position or not. In some implementations, a prism is arranged so as to complete a light path between a source and detector of the sensing mechanism when the rotatable gate is in the initial position. Alternatively, the sensing mechanism senses the rotatable gate in the initial position when the sensor coupling member blocks the light path between a source and detector of the sensing mechanism.

Other features and advantages will be apparent from the following detailed description and the accompanying drawings, and from the claims.

DETAILED DESCRIPTION OF THE DISCLOSURE

Figure 1:
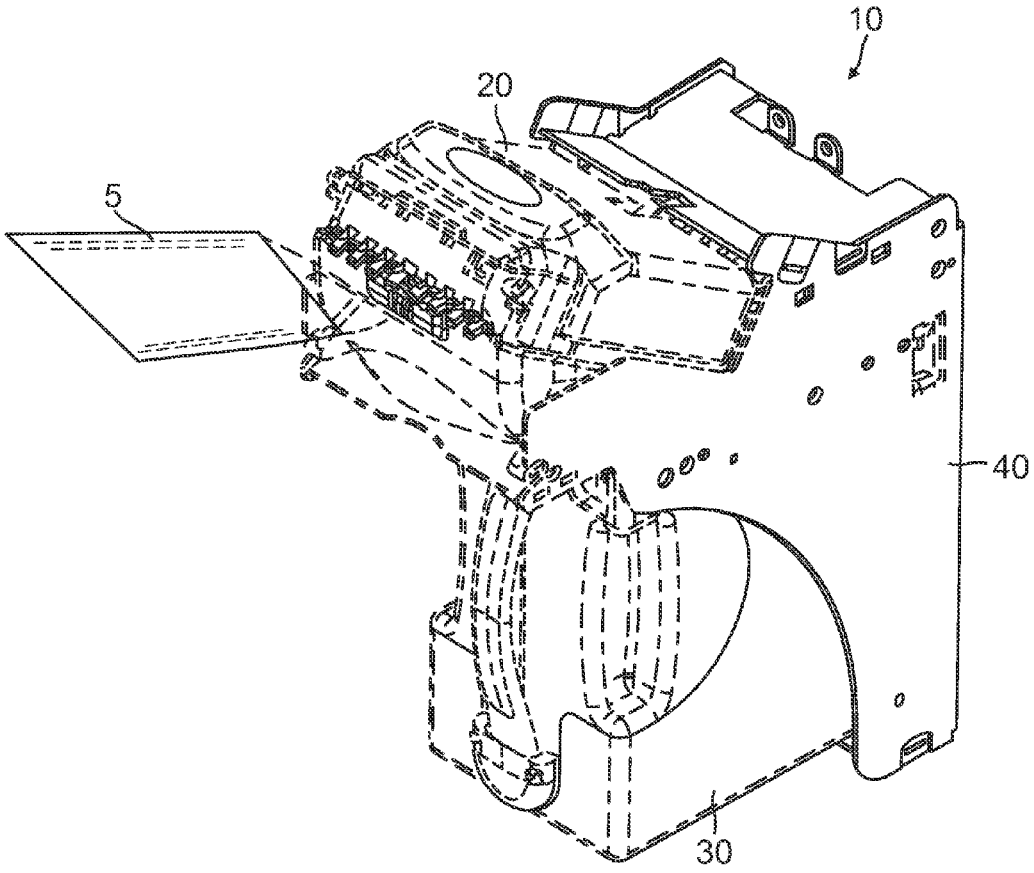
FIG. 1 illustrates an example of a currency handling apparatus.
Figure 2:
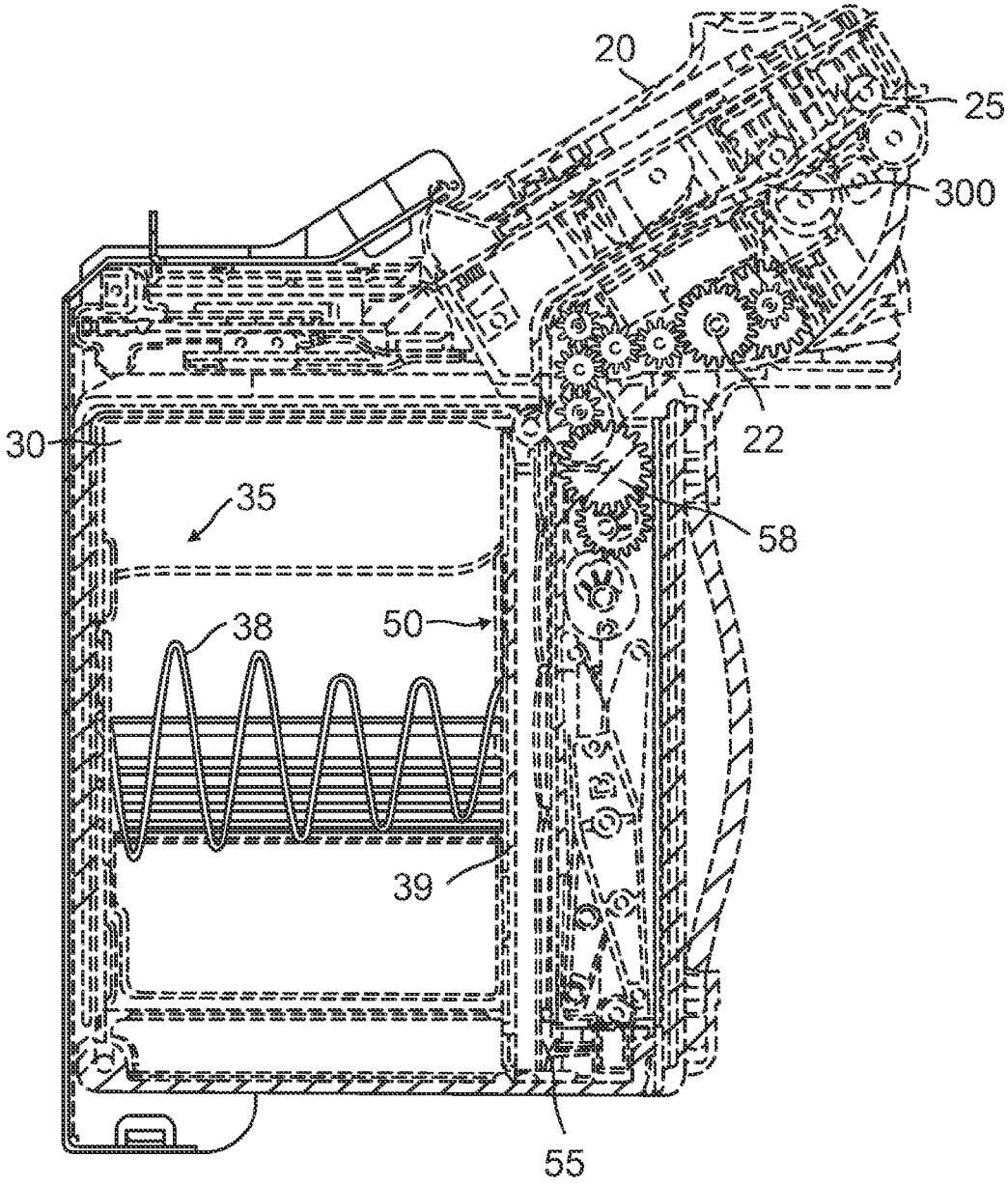
FIG. 2 illustrates the interconnection of various components of a currency handling apparatus.
Figure 3:
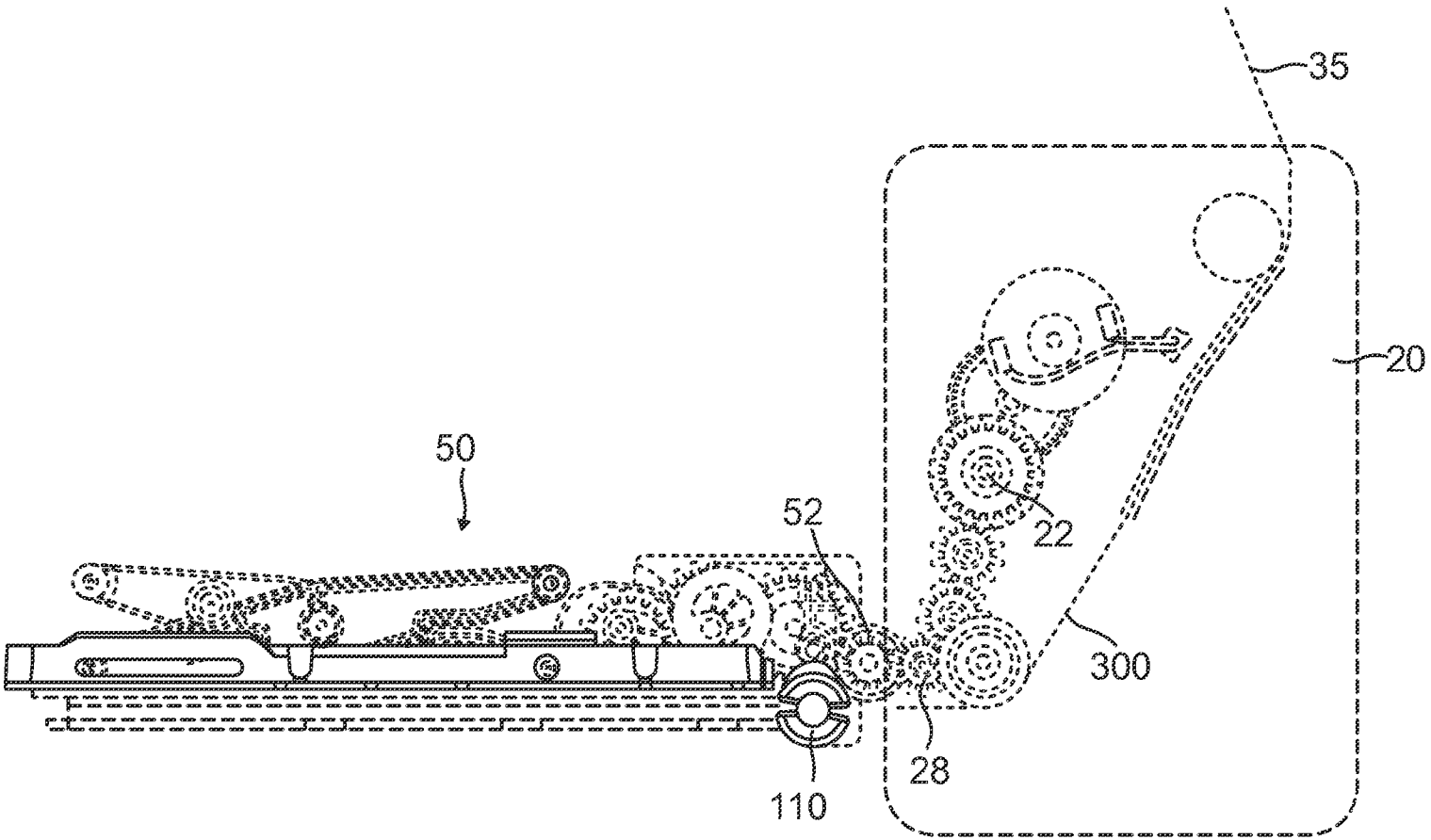
FIG. 3 illustrates an example of the coupling of a validation unit and stacking mechanism according to the invention.

As illustrated in the example of FIGS. 1-3, a currency handling apparatus 10 including a validation module 20, a removable storage unit 30, passageway 300, and a chassis 40. In some implementations validation module 20 is removably coupled to chassis 40. Validation module 20 can be configured to receive an item of currency at inlet 25 and transport currency item 5 past a sensing component to determine the type and validity of currency item 5 at inlet 25 and transport currency item 5 past a sensing component to determine the type and validity of currency item 5. In some implementations, validation module 20 further includes a transportation mechanism (not shown) for transporting currency item 5 through the validation module.

In some implementations, storage unit 30 includes a stacking mechanism 50 operatively coupled to a stacking drive assembly 22 of validation module 20. In other implementations stacking mechanism 50 is arranged such that it is a separate component from storage unit 30. Stacking mechanism 50 can be configured, for example, as a plunger type stacking mechanism as commonly known in the arts. Other configurations of stacking mechanism 50 can be used as well. In the illustrated example, stacking mechanism 50 can include actuation assembly 58, which includes a drive train comprised of a series of gears and which includes plunger extension means 59 including a scissor arrangement pivotally and slidingly coupled to plunger 55. Actuation assembly 58 includes a stacker coupling gear 52 for meshing engagement with a validator unit coupling gear 28 of stacking drive assembly 22.

In the illustrated example, currency storage unit 30 includes a pressure plate 39 and biasing spring 38 for storing items of currency in a stacked (e.g. face to face) relationship within a cavity 35 defined by the perimeter of storage unit 30. Storage unit 30 can be configured for removable coupling to chassis 40 as known in the art.

Figure 4:
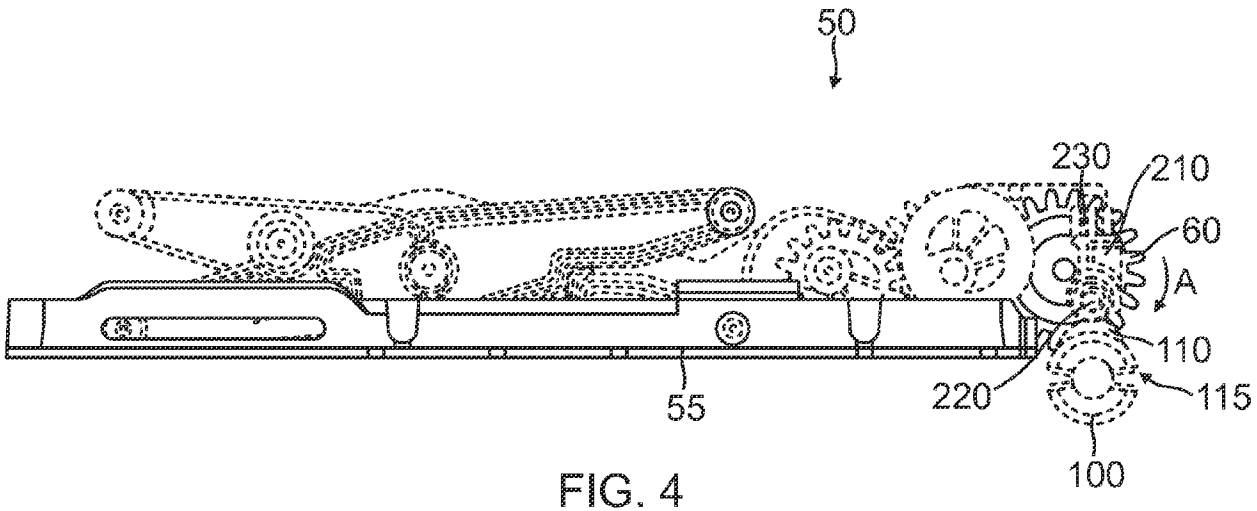
FIG. 4 illustrates an example of the security gate mechanism interconnected with a staking mechanism in an initial position according to the invention.
Figure 5:
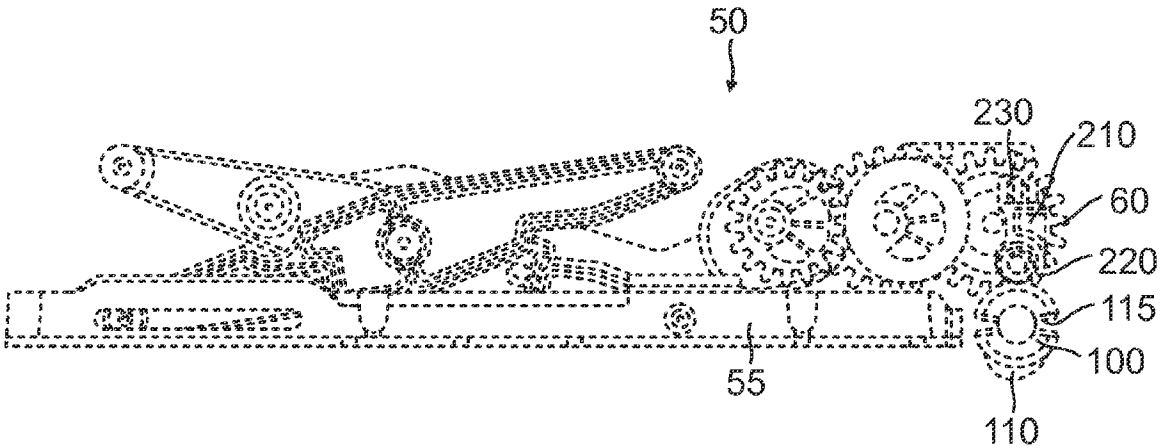
FIG. 5 illustrates the stacking mechanism and security gate mechanism, including the sensing system after actuation of the drive wheel in a first direction.
Figure 6:
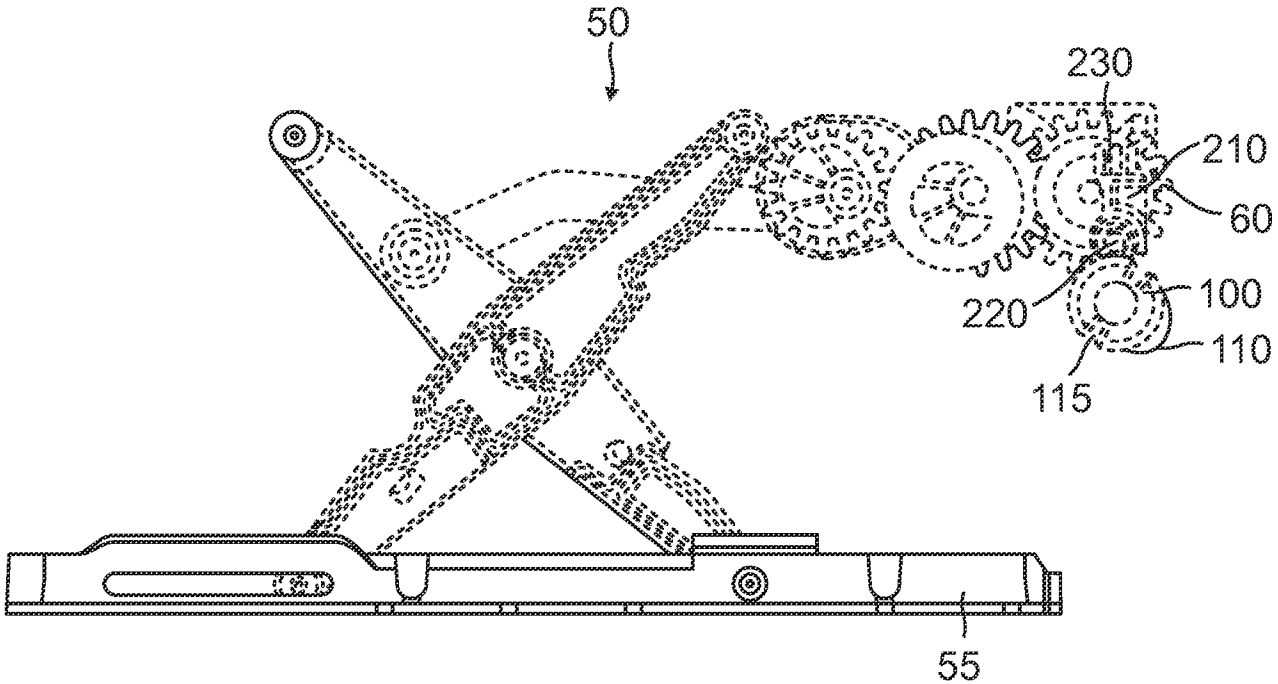
FIG. 6 illustrates the stacking mechanism extended during a stacking motion.

Currency handling unit 10 includes a security gate mechanism. As illustrated in the example of FIGS. 3 and 4, the security gate mechanism includes rotatable gate 100, having a slit 115 formed there through, and further includes drive wheel 60 operatively coupled to rotatable gate 100. In some implementations, drive wheel 60 is configured as a toothed gear for meshing engagement with rotatable gate 100. In other implementations, drive wheel 60 is coupled to rotatable gate 100 using a belt configuration or through rolling contact. In some implementations, drive wheel 60 can be further coupled to actuation assembly 58. In other implementations, drive wheel 60 is driven and controlled by a separate and independent actuator (e.g. a drive motor). Such an implementation allows for the security gate mechanism to be implemented at any position along passageway 300 for a desired application.

As illustrated in FIGS. 4-6 and 12-15, the security gate mechanism can include a position sensing system 200 for monitoring and determining the position of rotatable gate 100. In some implementations, rotatable gate 100 includes a sensing feature 110 on its periphery. As shown in the illustrated example, position sensing system 200 includes a sliding member 210 operatively coupled to rotatable gate 100 by roller 220. Roller 220 is arranged for rolling contact with a periphery of rotatable gate 100 so as to be displaced by sensing feature 110 as rotatable gate 100 rotates. In some implementations, position sensing system 200 can be operatively coupled to rotatable gate 100 via sliding contact or an electrical flag such as an encoder.

Figure 12:
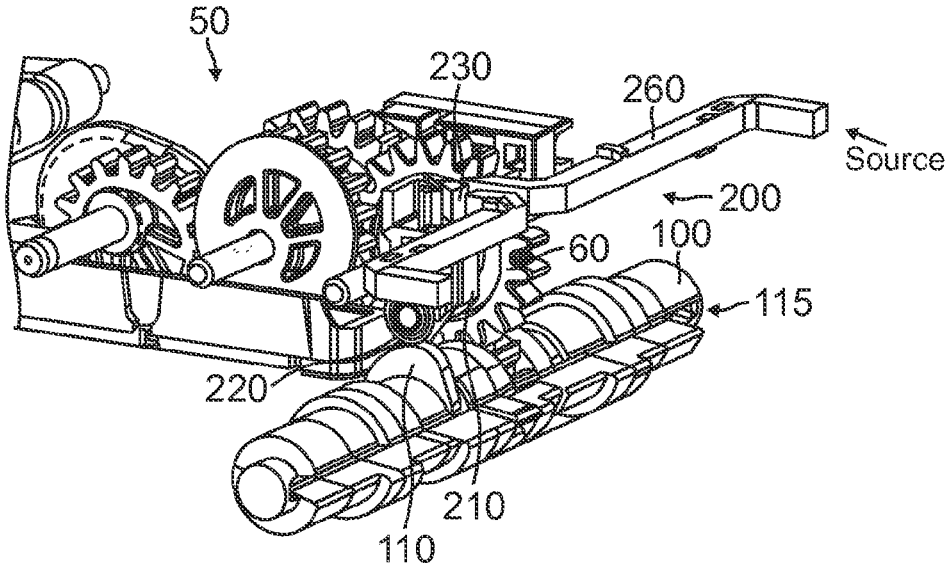
FIG. 12 illustrates an example of a position sensing system when the rotatable gate is in its initial position.
Figure 13:
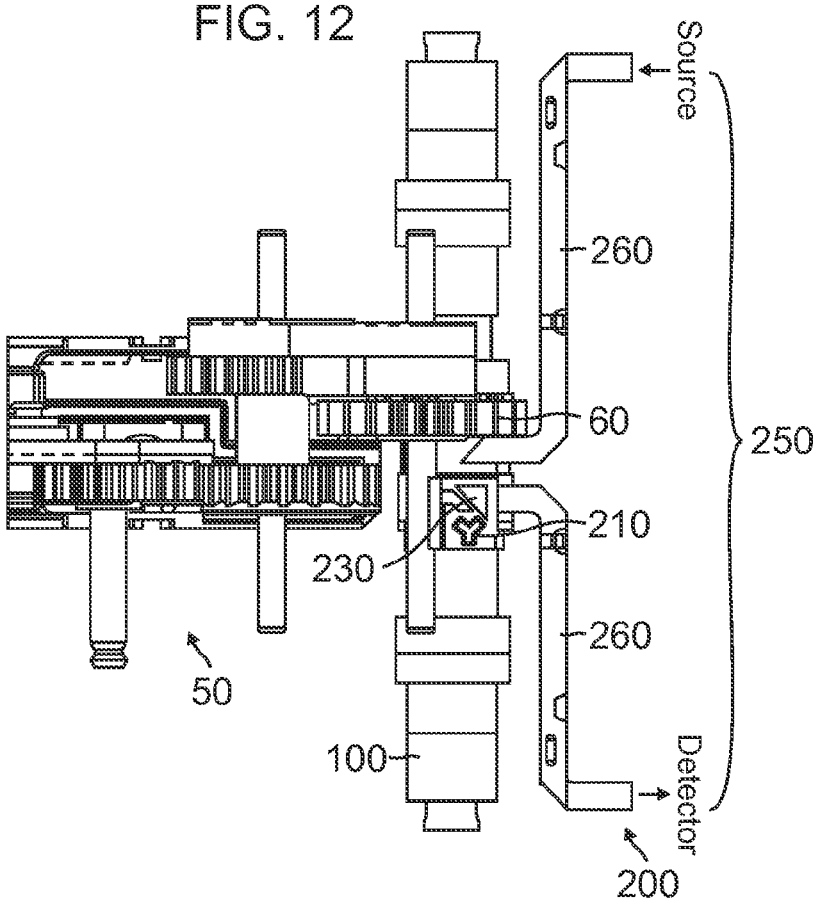
FIG. 13 illustrates further details of the position sensing system of FIG. 12.
Figure 14:
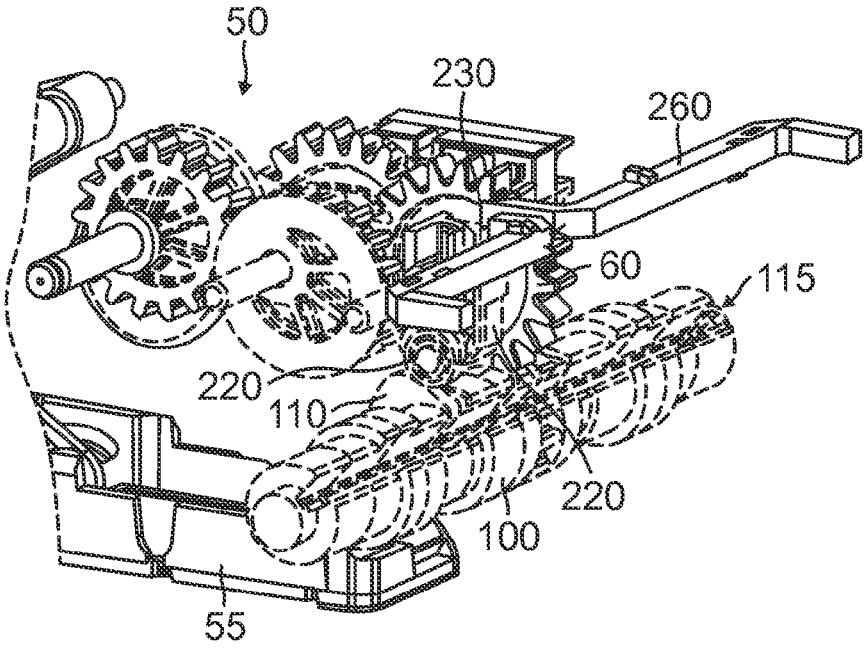
FIG. 14 illustrates the position sensing system when the rotatable gate is in a subsequent position.

In the illustrated example, sliding member 210 of sensing system 200 further includes a sensor coupling component 230 for operative coupling with a position sensor 250 of sensing system 200. In some implementations, sensor coupling component 230 is a portion of a light pipe 260 operatively coupling position sensor 250 with sensor coupling component 230. Sensor 250 can be arranged to include a source at first end of light pipe 260 and a detector at a second end of light pipe 260 as shown in FIG. 13. Sensor coupling component 230 can be arranged at a far end of sliding member 210 relative to roller 220 so that a light path is completed between the source and the detector when rotatable gate 100 is in an initial position as shown in FIG. 12. In other implementations, sensor coupling component 230 and sensor 250 can be arranged to form a Hall effect sensing system.

In the example illustrated in FIGS. 7-11, the security gate mechanism further includes a positioning member 80 for selective engagement with drive wheel 60. In some configurations the security gate mechanism further includes a positioning gear 150 operatively coupled between drive wheel 60 and positioning member 80. Drive wheel 60 can include a compound gear 62 located thereon for meshing engagement with positioning gear 150. Use of a compound gear 62 for coupling drive wheel 60 and positioning gear 150 is an example to attain a desired gear ratio; however, positioning gear 150 and drive wheel 60 can be coupled through standard meshing engagement of gears. In the illustrated example, positioning gear 150 includes a variable cam surface 155 and positioning gear abutment surface 158 operatively coupled with positioning member 80. Positioning member 80 includes a cam follower surface 82 and locator abutment surface 86. The positioning member 80 is biased in a direction towards variable cam surface 155 via biasing spring 85. In other implementations positioning member 80 is pivotally configured so as to engage drive wheel 60 without varying in scope from the current disclosure.

The operation of currency handling apparatus 10 and the security gate mechanism is now described. An item of currency 5 is inserted into currency handling apparatus 10 at inlet 25 (see FIG. 1). The transportation mechanism (not shown) of validation module 20 transports currency item 5 past a sensing component (not shown) to determine the type and validity of currency item 5. Once a determination of validity of currency item 5 is made by validation module 20, the transportation mechanism of validation module 20 continues to transport currency item 5 along passageway 300, through slit 115 of rotatable gate 100, and into a position adjacent stacking mechanism 50. Once currency item 5 is located in a position adjacent stacking mechanism 50, stacking drive assembly 22 (see FIG. 3) is actuated to stack currency item 5 into storage unit 30 as will be described in more detail below.

Actuation of stacking drive assembly 22 causes validator unit coupling gear 28 to rotate. Rotation of validator coupling gear 28 causes complementary rotation of stacker coupling gear 52 due to the meshing engagement between the gears. Stacker coupling gear 52, through meshing engagement with drive wheel 60, causes rotation of member 60 in a first rotational direction A. Through meshing engagement of positioning gear 150 with step gear 62 of drive wheel 60, positioning gear 150 rotates in a direction indicated by X and is opposite of direction A.

Figure 7:
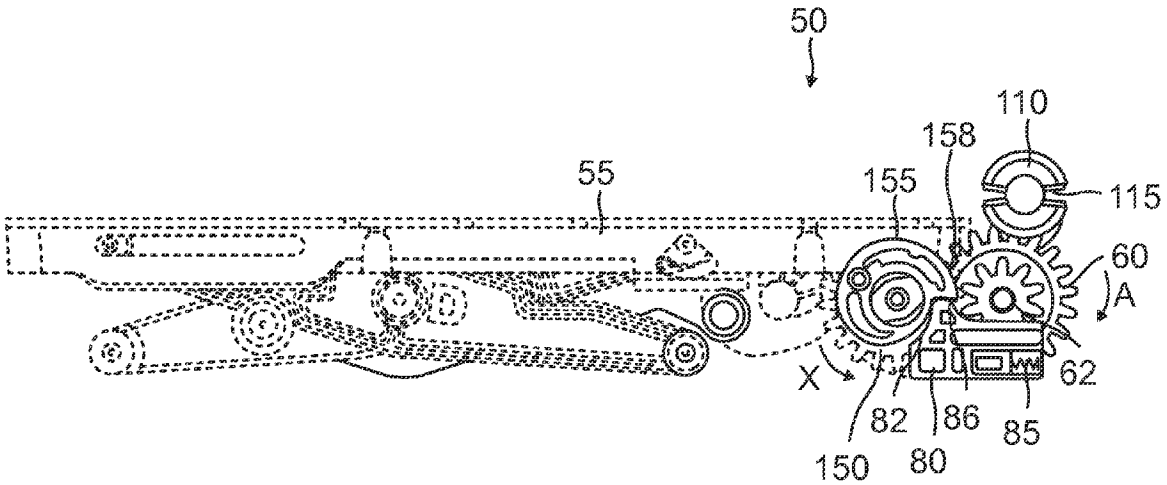
FIG. 7 illustrates the stacking mechanism and security gate mechanism in an initial position.
Figure 8:
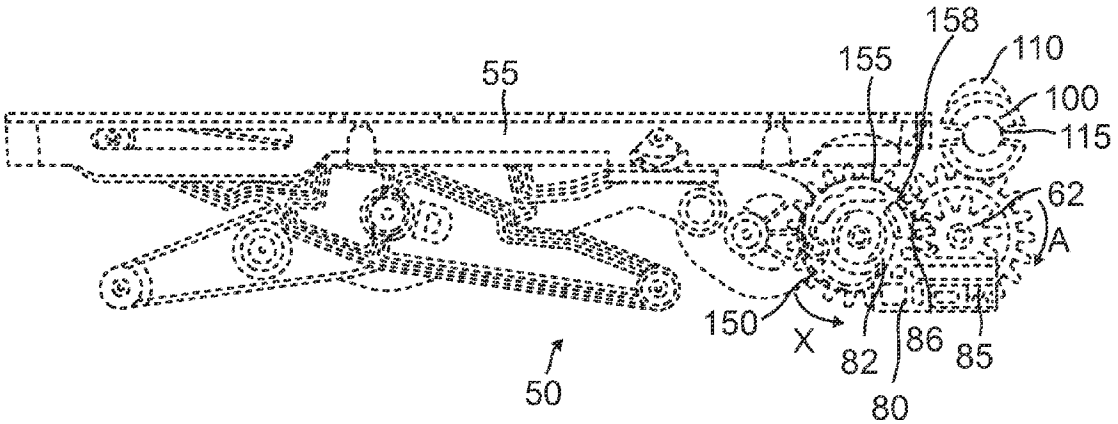
FIG. 8 illustrates the security gate mechanism after actuation of the drive wheel in a first direction.
Figure 9:
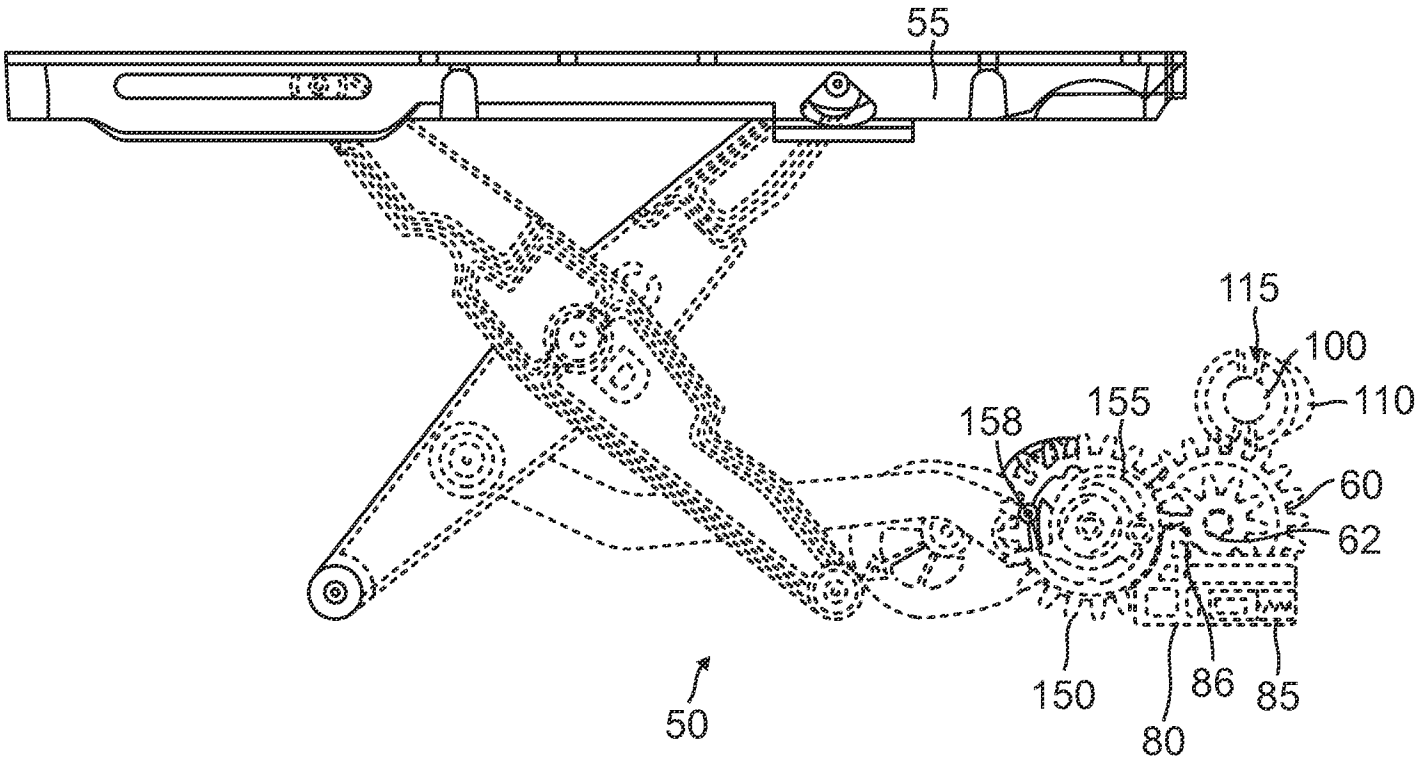
FIG. 9 illustrates the security mechanism when the stacking mechanism is in an extended position during a stacking cycle.

Prior to actuation of stacker driving assembly 22, positioning gear 150 and rotatable gate 100 are positioned in an initial position as shown in FIG. 7. In the initial position, positioning member 80 is positioned in a blocking position whereby positioning gear abutment surface 158 and locator abutment surface 86 are in abutment. As drive wheel 60 begins to rotate in direction A, complementary rotation of positioning gear 150 begins to rotate in direction X thereby moving positioning gear abutment surface 158 and locator abutment surface 86 out of abutment. Additionally, as positioning gear 150 rotates in direction X, positioning member 80 slides along cam surface 155 at cam follower surface 82. Movement of positioning gear 150 causes cam surface 155 to slide relative to cam follower surface 82. As a result of the variable radius of positioning gear cam surface 155, positioning member 80 begins to be displaced linearly relative to the rotational axis of positioning gear 150 and thus begins to move out of a blocking position. Movement of positioning member 80 from a blocking position to a non-blocking position compresses a biasing member 85.

In conjunction with the rotation of drive wheel 60, the meshing engagement of rotatable gate 100 with drive wheel 60 causes gate 100 to rotate. Prior to actuation of stacking drive assembly 22, rotatable gate 100 is positioned in an initial position whereby slit 115 is aligned with passageway 300 such that an item of currency can pass there through. As drive wheel 60 causes rotation of rotatable gate 100 (se FIG. 8), slit 115 moves from an initial position allowing passage of a currency item, to a position whereby slit 115 is no longer aligned with passageway 300 (see FIG. 9).

In some implementations, drive wheel 60 is meshing engaged with rotatable gate 100 having gear teeth arranged at a far end of the body of rotatable gate 100. In other implementations, as shown in the figures, the gear teeth of rotatable gate 100 are arranged within the body of rotatable gate 100 in a manner whereby slit 115 bisects the circumference of the toothed pattern of rotatable gate 100.

Figure 10:
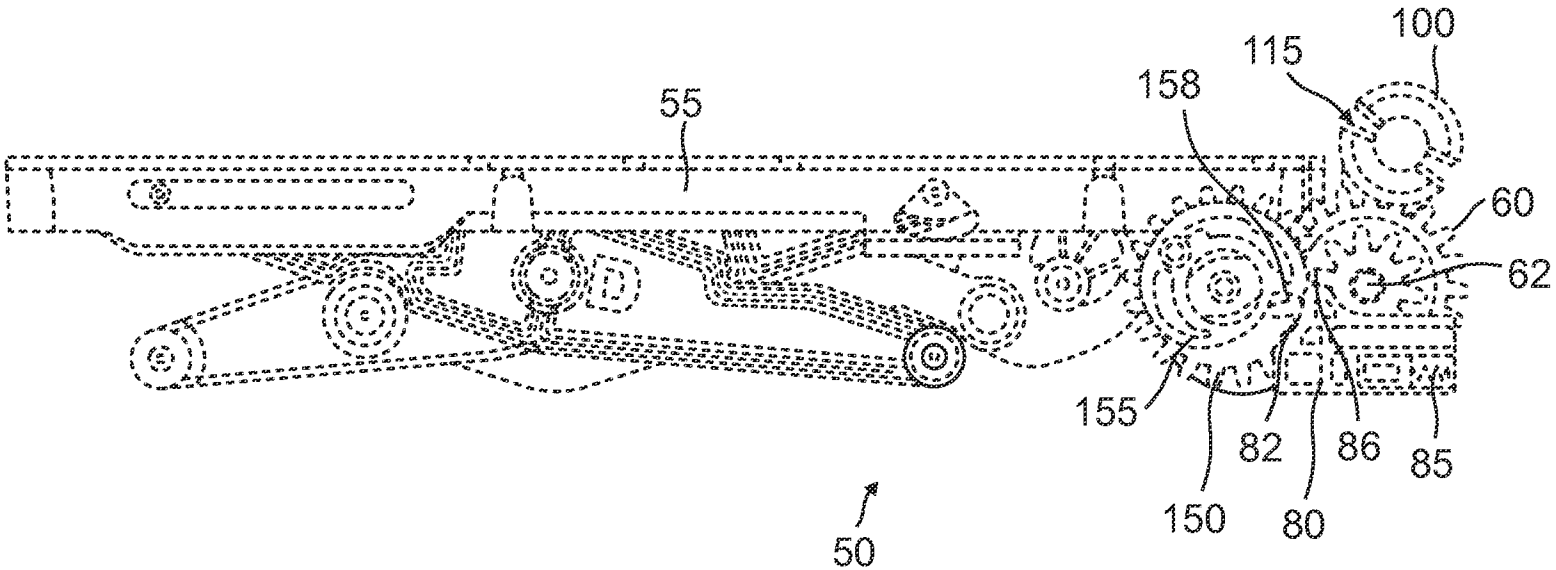
FIG. 10 illustrates the positioning member in a non-blocking position.
Figure 11:
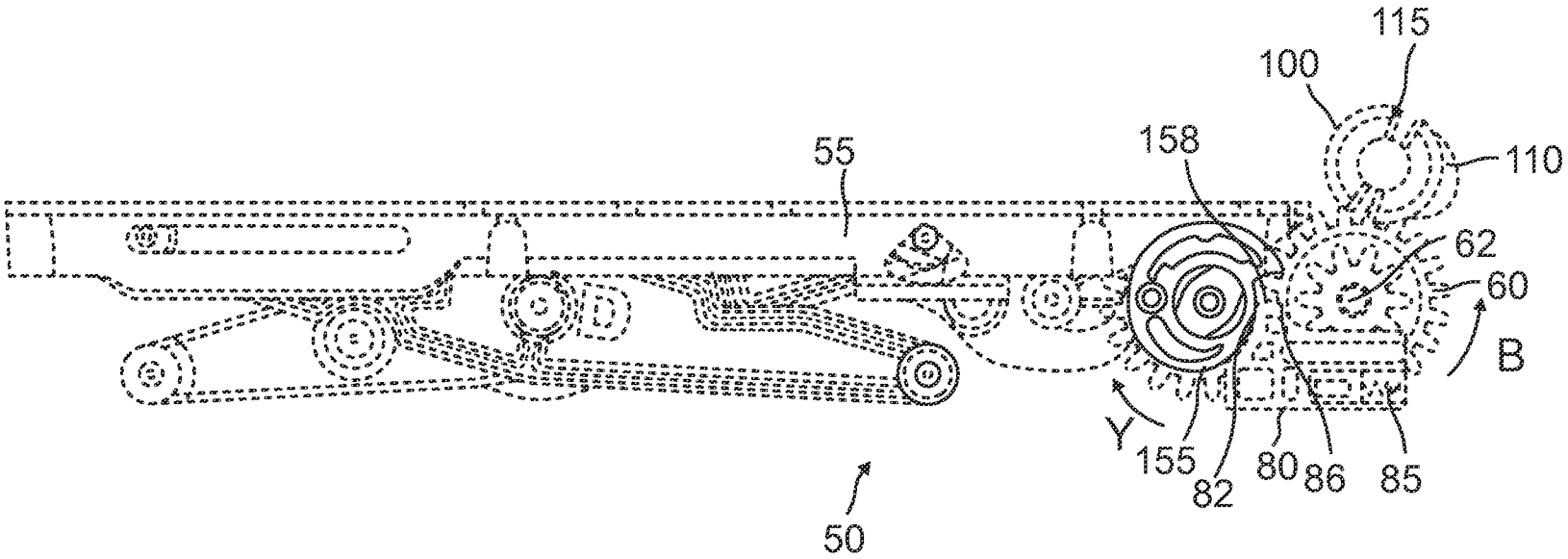
FIG. 11 illustrates the security gate mechanism in a position having the positioning member in a blocking position and indicating the second direction of motion to return the rotatable gate to an initial position.

Continued actuation of stacking drive assembly 22, and thus rotation of positioning gear 150, causes cam surface 155 to continue to slide past and along cam follower surface 82 and further displacing positioning member 80 from a blocking position. Because the security gate mechanism is integrated into stacker mechanism 50, rotatable gate 100 will continue to rotate in the first direction as plunger 55 cycles through the stacking motion. As plunger 55 approaches the return position, positioning gear abutment surface 158 approaches locator abutment surface 86 as shown in FIG. 10. As plunger 55 returns to a home position, positioning member 80 returns to a blocking position as shown in FIG. 7. Stacking drive assembly 22 continues to rotate positioning gear 150 in direction X past the initial position allowing positioning member 80 to return to a blocking position. At this point stacking drive assembly 22 is stopped from rotating positioning gear 150 in the first direction X resulting in a separation between positioning gear abutment surface 158 and locator abutment surface 86 as shown in FIG. 11.

To position rotatable gate 100 back into the initial position, stacking drive assembly 22 is actuated in a reverse direction resulting in rotation of drive wheel 60 in a second direction B, which is opposite the first direction A. As a result of operating stacking drive assembly 22 in a reverse direction, positioning gear 150, via meshing engagement with drive wheel 60, also rotates in a second direction Y, opposite of the first direction X. Rotation of positioning gear 150 in a second direction Y causes positioning gear abutment surface 158 and locator abutment surface 86 to come into abutment at the initial position. Concurrently, due to the meshing engagement of rotatable gate 100 with driving gear 60, rotatable gate 100 also rotates in a second direction (i.e. reverse or opposite the first direction). Therefore once abutment between surfaces 158 and 86 is achieved, rotatable gate 100 has been returned to an initial position whereby slit 115 is again aligned with passageway 300.

Figure 15:
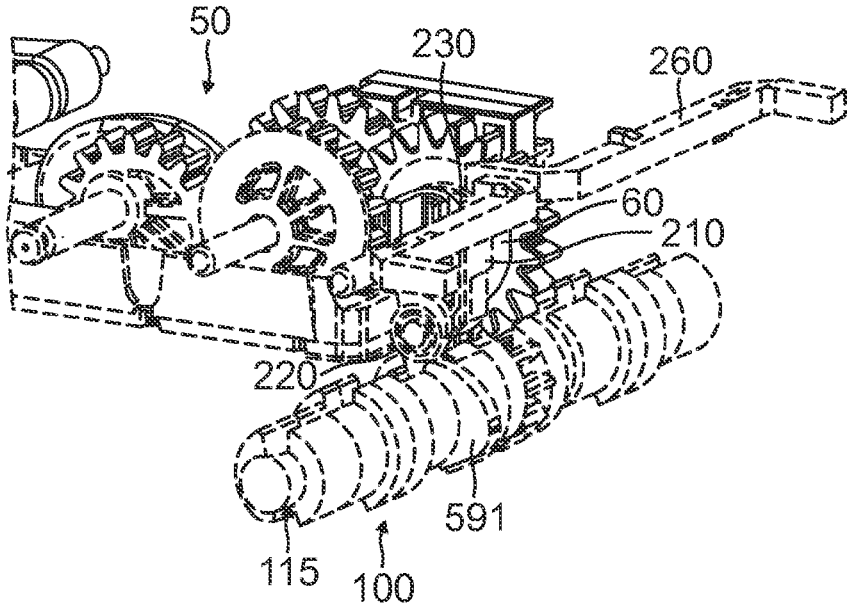
FIG. 15 illustrates the position sensing system when the rotatable gate is in yet another position.

The operation of position sensing system 200 is described next. Starting from the initial position with rotatable gate 100 aligned with passageway 300, sliding member 210 and roller 220 are in rolling contact with sensing feature 110 as shown in FIG. 12. In implementations in which sensing feature 110 is a protrusion at the periphery of rotatable gate 100, roller 220 and sliding member 210 are displaced linearly relative to the rotation axis of rotatable gate 100. As stacking drive assembly 22 is actuated in a first direction A, rotatable gate 100 begins complementary rotation in a first direction. As rotatable gate 100 rotates, roller 220 moves along and the surface of sensing feature 110 allowing linear displacement of sliding member 210 in a direction towards the periphery surface of rotatable gate 100 (via a sensing biasing member) as shown in FIG. 12 and FIG. 13. When roller 220 is no longer in contact with sensing feature 110, sliding member is urged towards rotatable gate 100 and held in an extended position by a physical stop (e.g. a travel limit) preventing further movement towards rotatable gate 100. The physical stop prevents roller 220 from contacting the remaining periphery of rotatable gate 100 once roller 220 and sensing feature 110 are no longer in contact as shown in FIG. 15. Continued rotation of rotatable gate 100 allows roller 220, and thus sliding member 210, to remain in an extended position relative to the initial position, until sensing feature 110 again comes into rolling contact with roller 220.

When sliding member 210 is in a position contacting sensing feature 110, sensor coupling component 230 is in a position completing the light path of light pipe 260 such that sensor 250 senses that slit 115 is in a position aligned with passageway 300. In some implementations, during a full stacking cycle of stacking mechanism 50, sensing system 200 may sense rotatable gate 100 becoming aligned with passageway 300 multiple times. The number of rotations rotatable gate 100 moves through depends on specific configurations (e.g. gear train ratios) of actuation assembly 58.

In the forgoing implementations, the security gate mechanism has been described as an integrated unit of stacking mechanism 50, however the security gate mechanism can be configured as a separate unit operatively coupled to passageway 300 at any point to facilitate the prevention of a fraudulent attempt to remove an item of currency from currency handling apparatus 10. For example security gate mechanism can be configured to be driven by an actuator (not shown) operatively coupled to driving gear 60 and controlled separate from other transportation event and and/or stacking events of currency handling apparatus 10. An advantage of the disclosed security gate mechanism is that attempts to fraudulently remove a currency item 5 from handling apparatus 10 (e.g. by a string attached thereto) can be prevented by actuating drive gear 60 so as to rotate rotatable gate 100 resulting in any string attached to currency item 5 becoming wound around rotatable gate 100. If an attempt to remove a currency item 5 having a string attached thereto occurs, reverse rotation of rotatable gate 100 will be prevented by the abutment between positioning member 80 and drive wheel 60 as described herein.

In the implementations described above the position sensing system 200, the security gate mechanism, and the stacking mechanism 50 are all actuated simultaneously due to the security gate mechanism being integrated and actuated by stacking drive assembly 22. In other implementations whereby the security gate mechanism can be actuated and controlled independently of stacking mechanism 50, stacking drive assembly 22, or the position sensing system. An example of currency handling apparatus 10 having an independently actuated and controlled security gate mechanism would be a stackerless configuration whereby currency handling apparatus 10 does not have a currency storage unit 30 for stacking accepted currency. In such an apparatus the security gate mechanism would be integrated into apparatus 10 such that it is arranged along passageway 300.

An additional feature of the security gate mechanism is that if a "fishing" element is attached to an item of currency inserted into currency handling apparatus, rotation of rotatable gate 100 can recognize its presence. When the "fishing" element is a string attached to the currency item, rotation of rotatable gate 100 causes the string to become wound around rotatable gate 100. When the "fishing" element is a more rigid substance (e.g. tape or thin plastic sheet) rotation of rotatable gate will impact the fishing element and cause the current required to continue rotation of rotatable gate 100 will exceed predetermined thresholds (e.g. current draw limits) and thus signal that an element is present in passageway 300.

Figure 16:
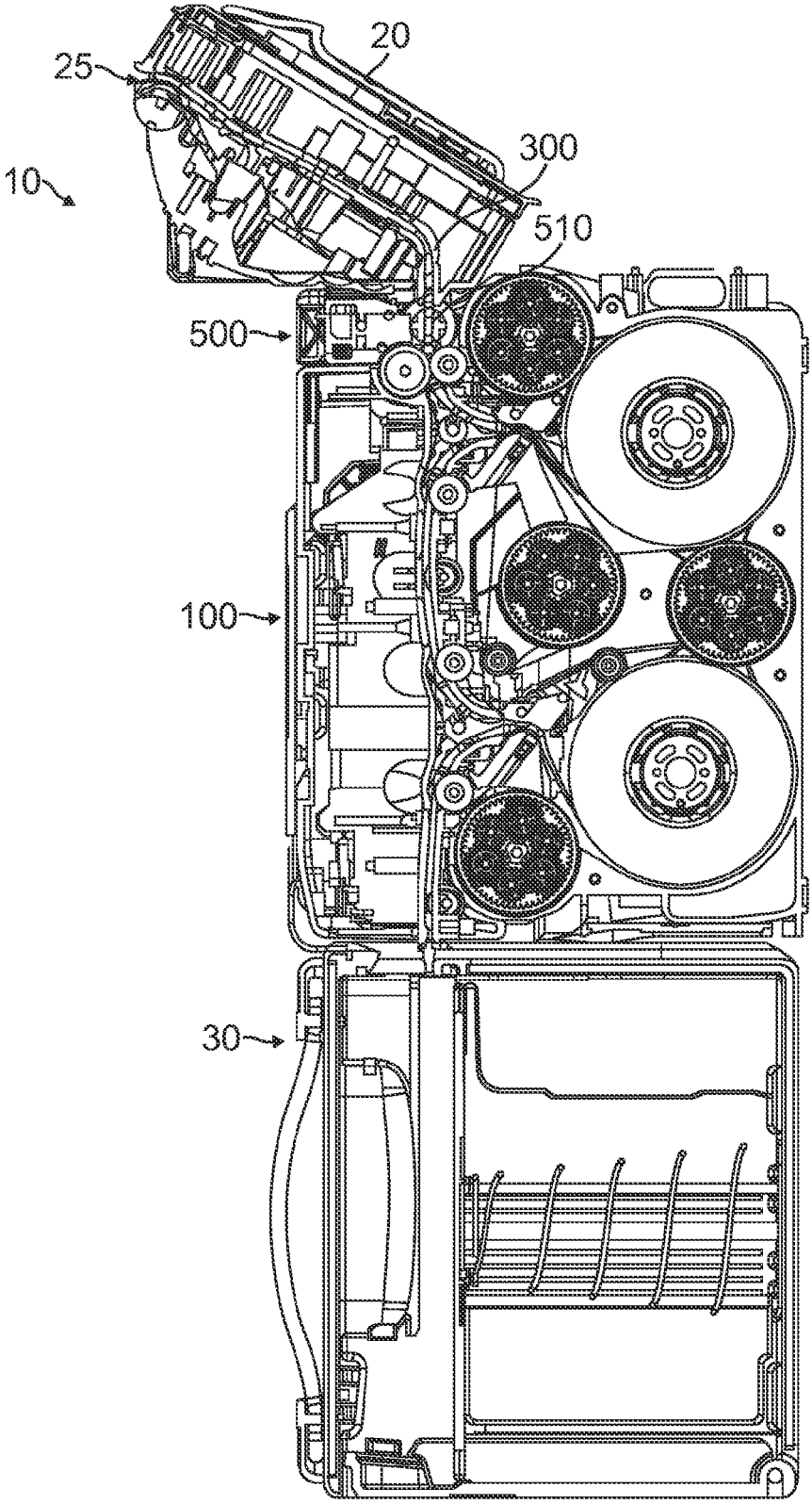
FIGS. 16 to 36 illustrate various views of the security gate mechanism and its components.
Figure 17:
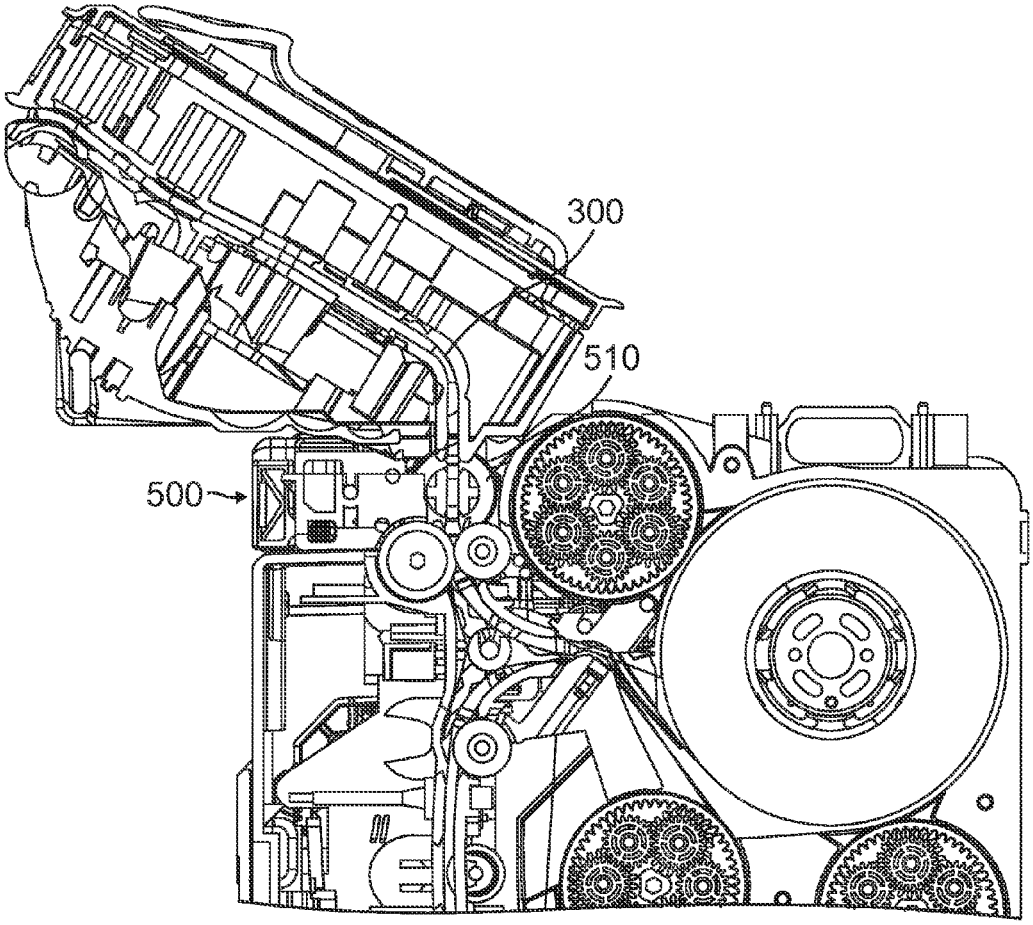
Figure 19:
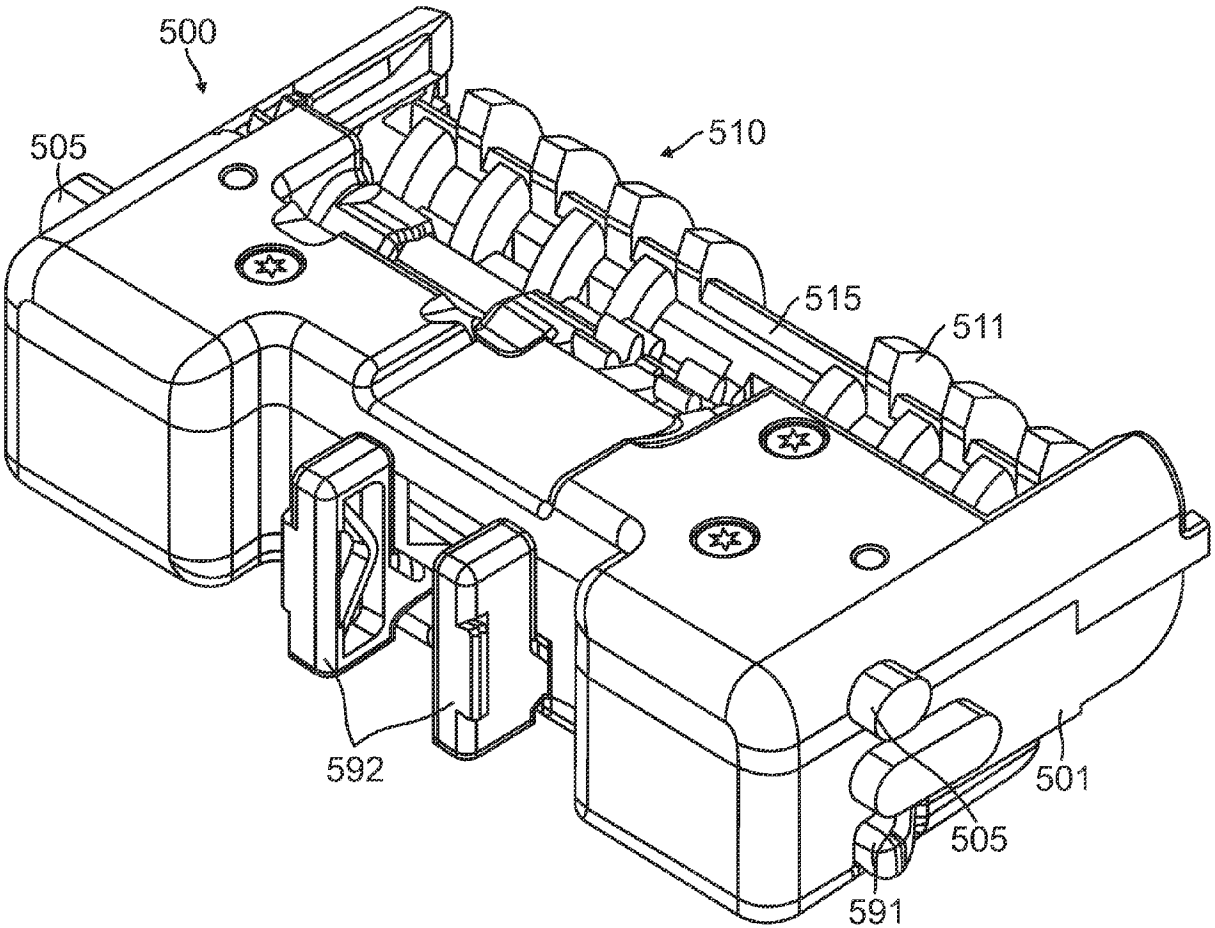
Figure 20:
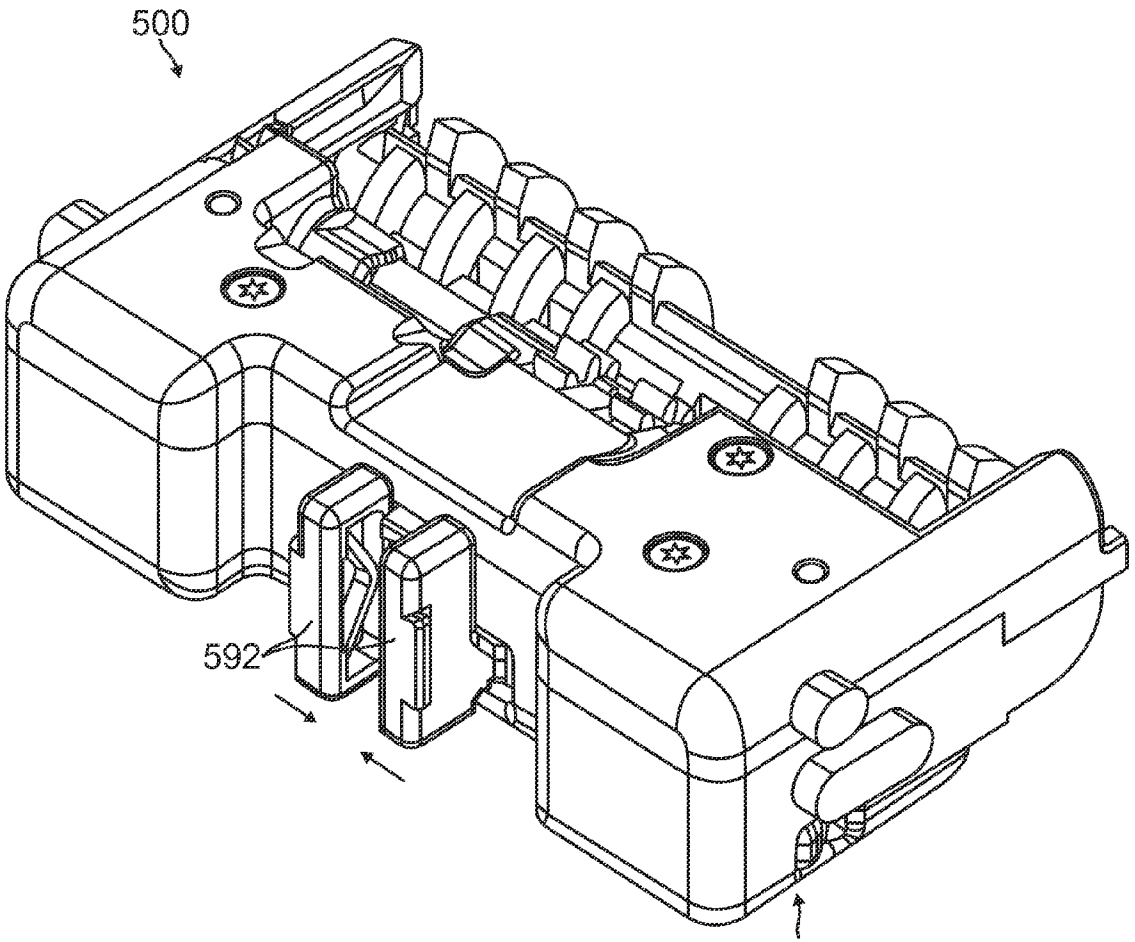
Figure 21:
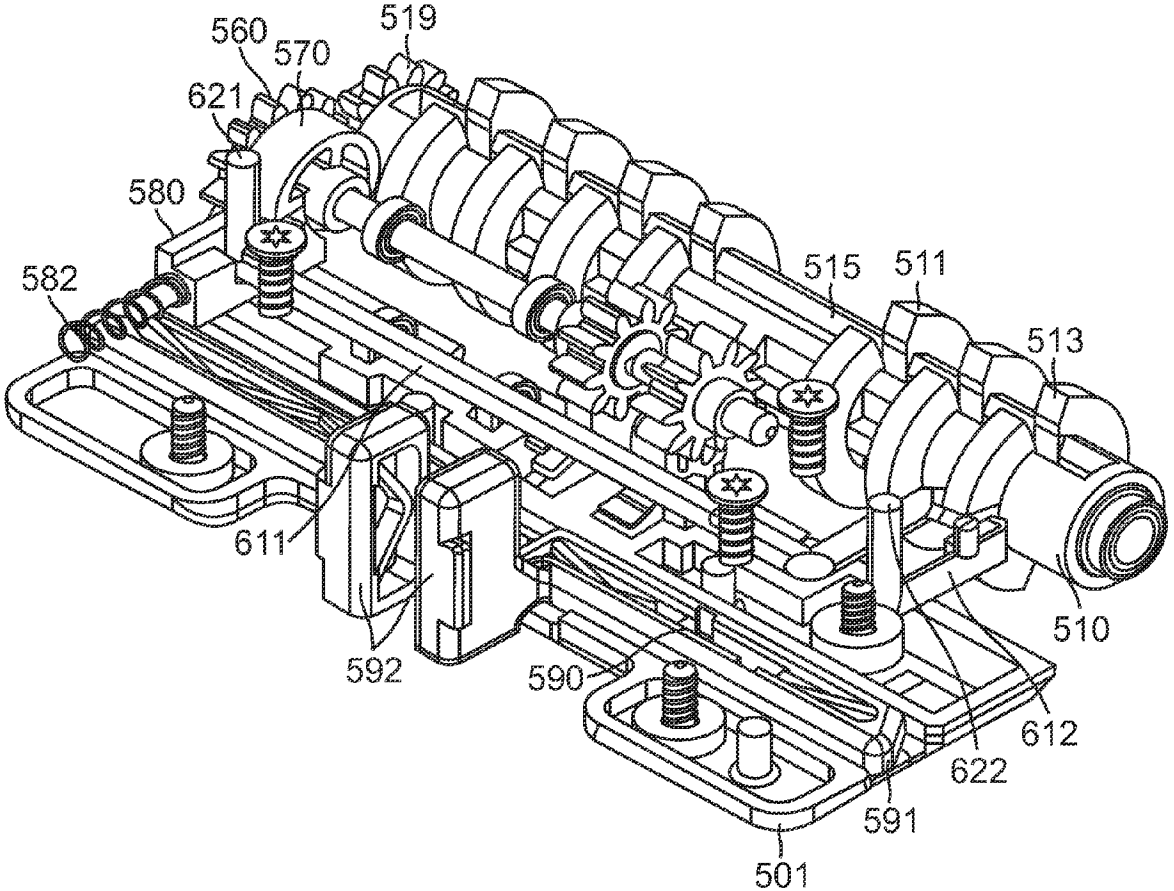
Figure 22:
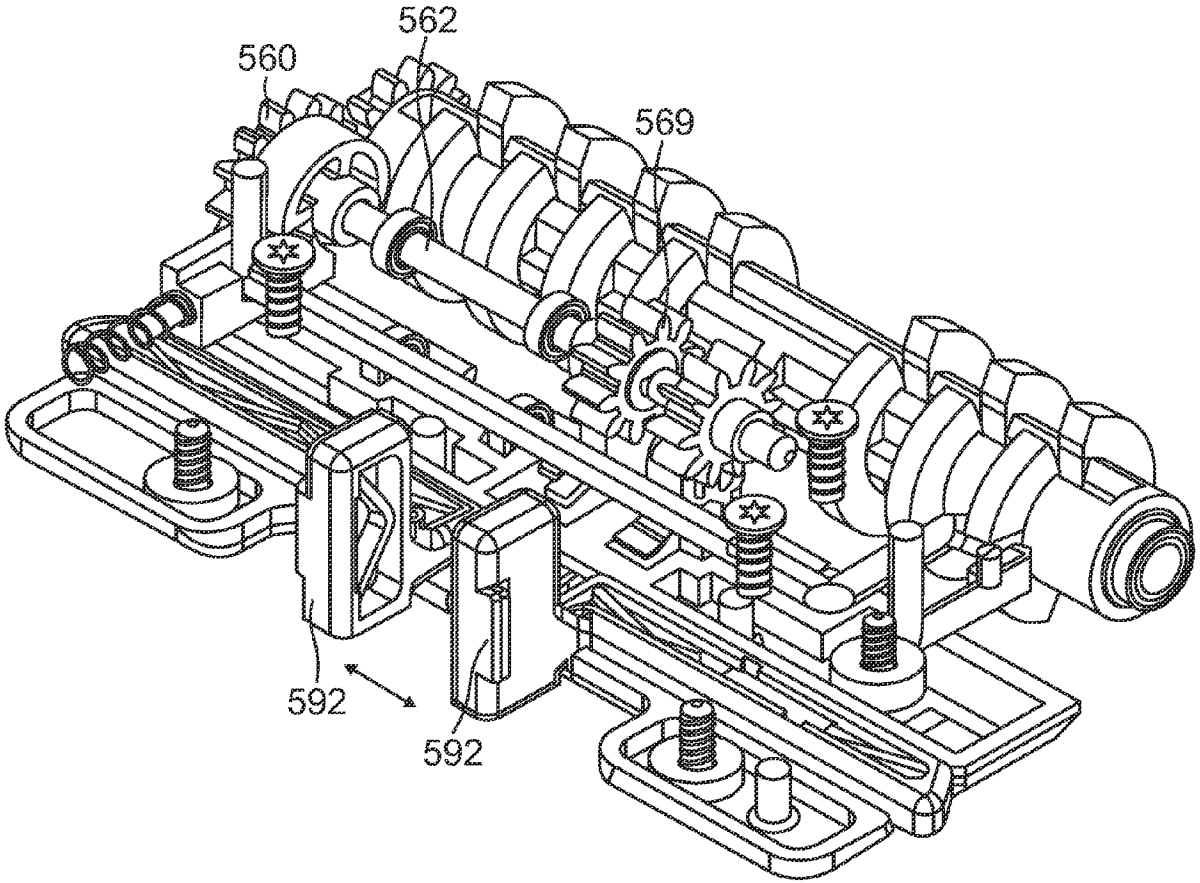
Figure 23:
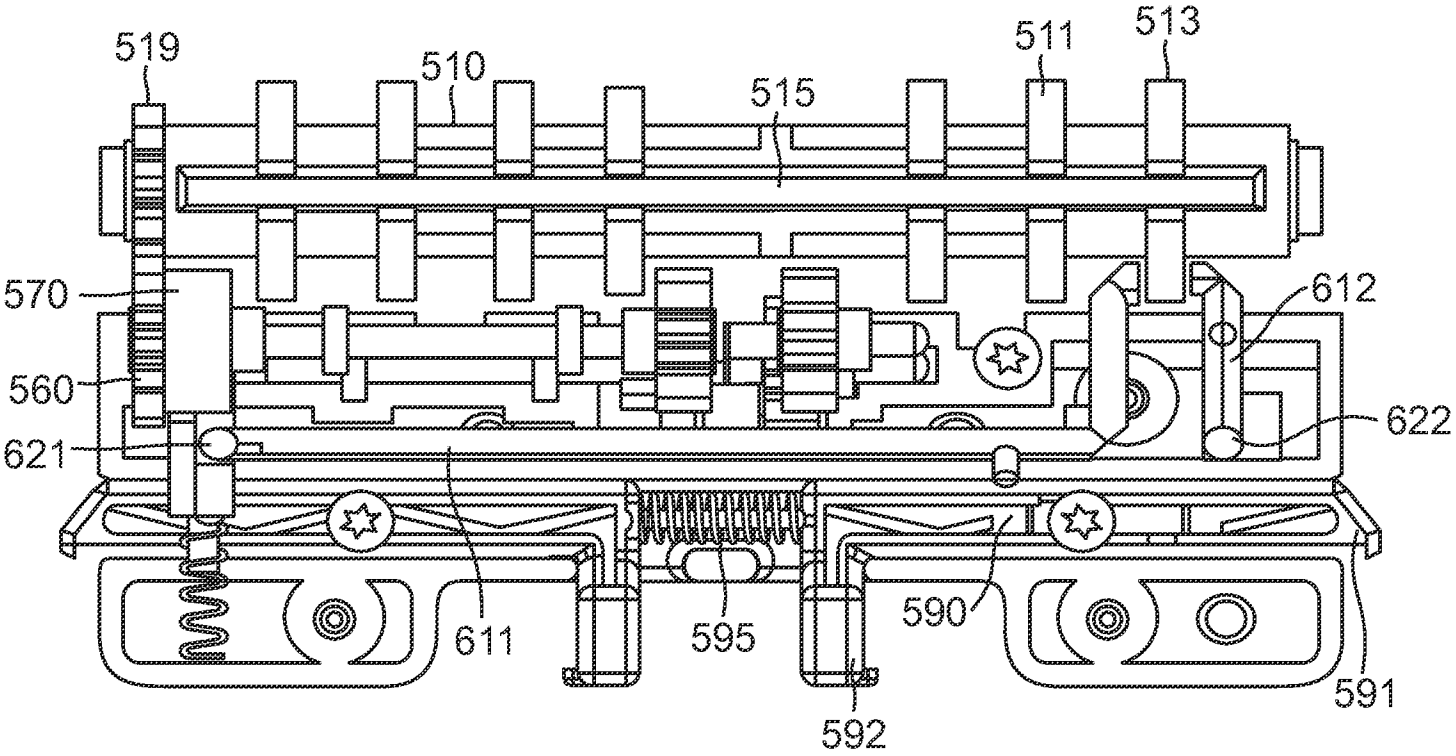
Figure 25:
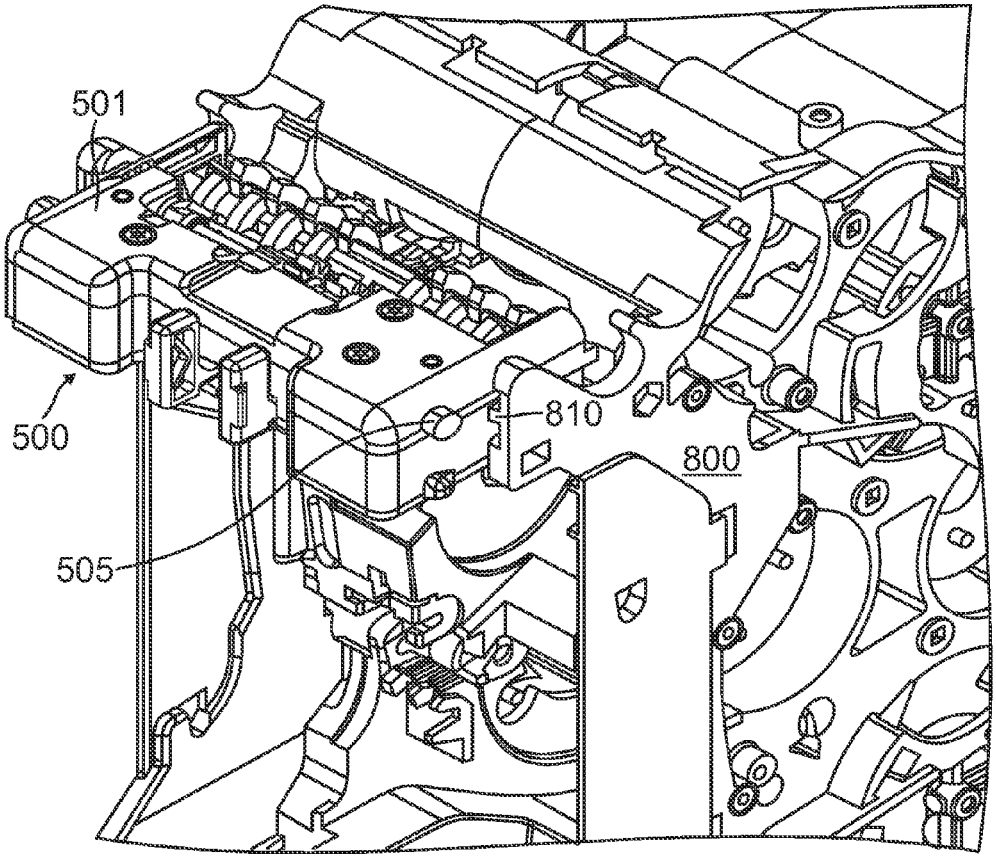

In the example embodiment illustrated in FIG. 16, a removable security gate mechanism 500 is removably coupled to a currency handling apparatus 10. Currency handling apparatus includes a validator 20, security gate mechanism 500 (see FIG. 19), recycling module 1000, and cashbox 30. Security gate mechanism 500 includes a housing 501 configured for selective coupling with a currency handling apparatus 10 (see FIG. 25). In the illustrated example, housing 501 includes guide tabs 505 for sliding engagement with the guide recesses 810 of currency handling apparatus 10. In some implementations currency handling apparatus 10 includes a unit frame 800 configured to mount the validator 20, security gate mechanism 500, recycling module 1000, and cashbox 30. To increase the flexibility of currency handling apparatus 10, each of the validator 20, security gate mechanism 500, recycling module 1000 and cashbox 30 can be selectively and independently removable from currency handling apparatus 10 or frame 800.

In some implementations, housing 501 includes a locking mechanism 700 for selectively locking security gate mechanism 500 within currency handling apparatus 10. In the illustrated example of FIGS. 19-24, locking mechanism 700 includes a pair of movable locking arms 590, slidably coupled to housing 501. Each movable locking arm 590 includes a locking tab 591 at one end of the movable locking arm 590 and a release tab 592 at the other end of locking arm 590. In the illustrated example, locking arms 590 are biased away from each other and towards a locked position by lock bias 595. In some implementations lock bias 795 is a biasing spring located between locking arms 590 for biasing the arms to an extended position causing locking tabs 591 to extend through an opening in housing 501.

Figure 24:
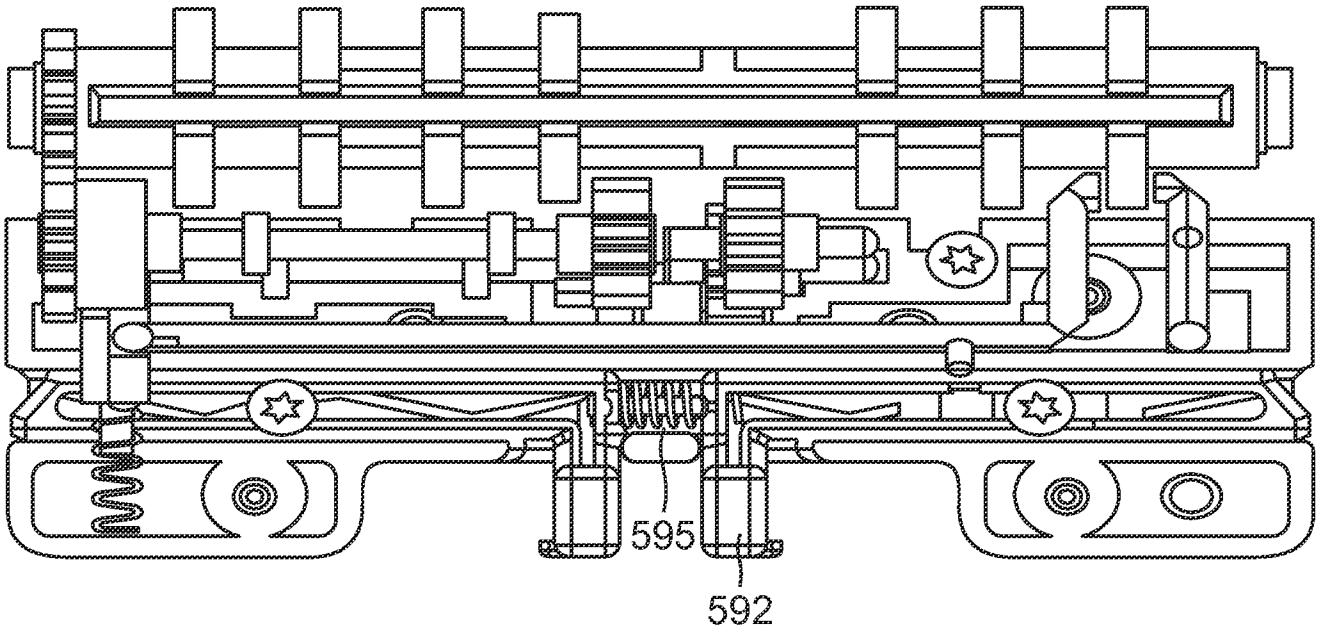
Figure 26:
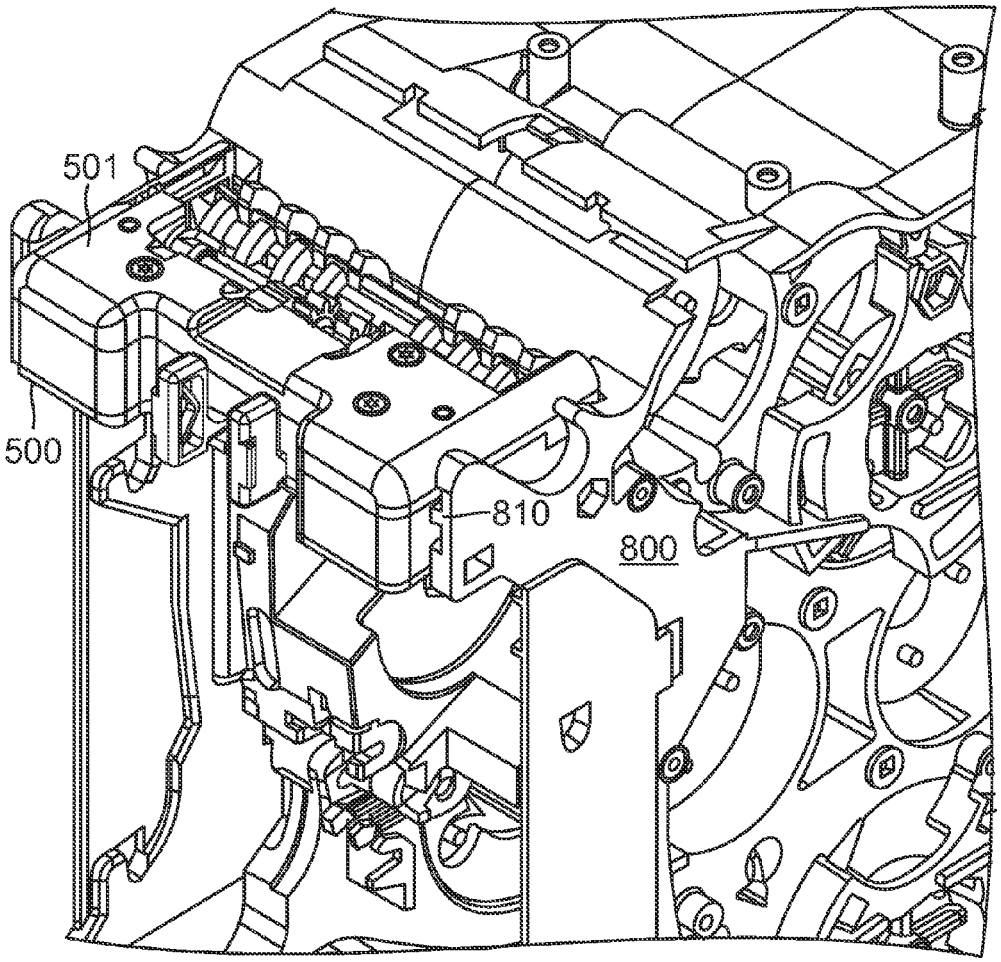
Figure 27:
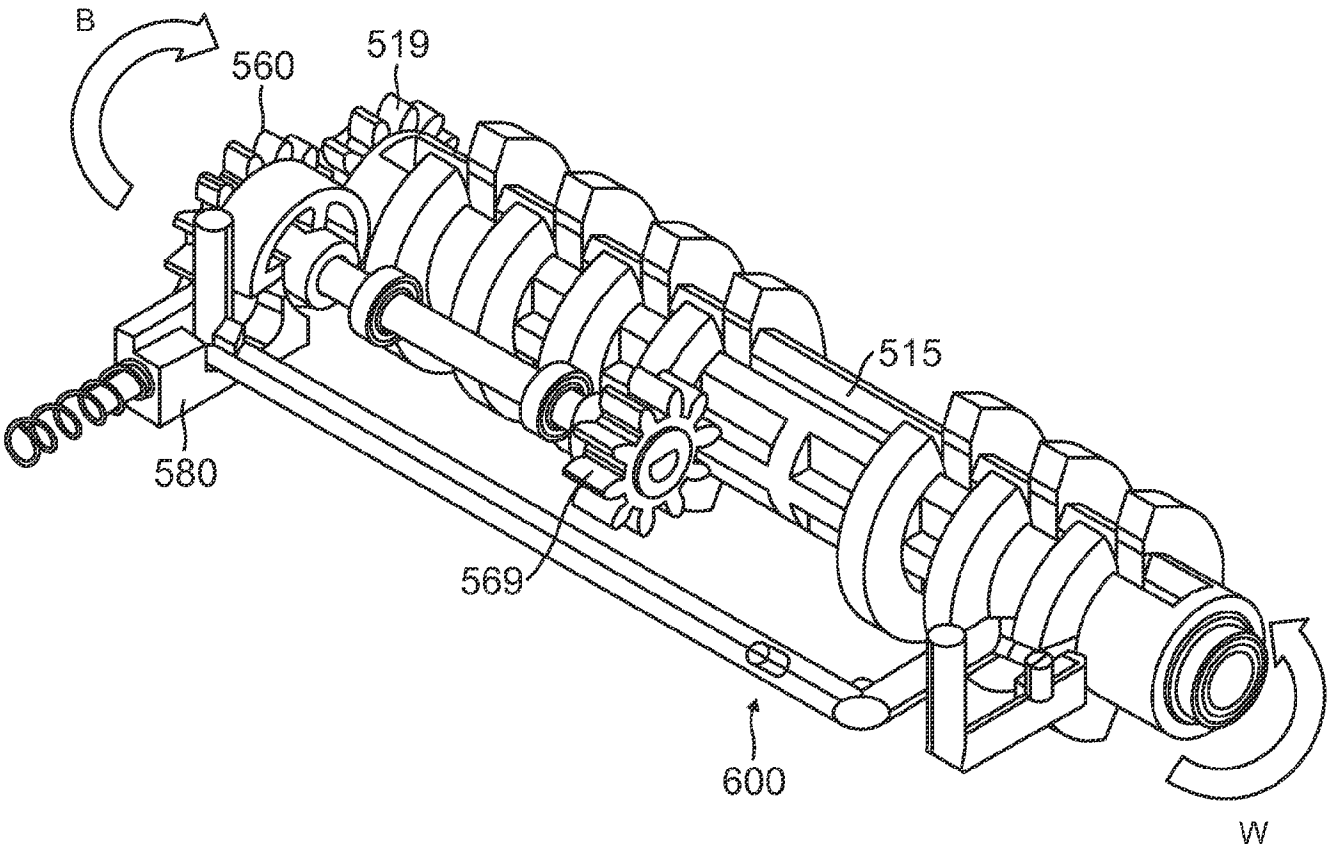
Figure 28:
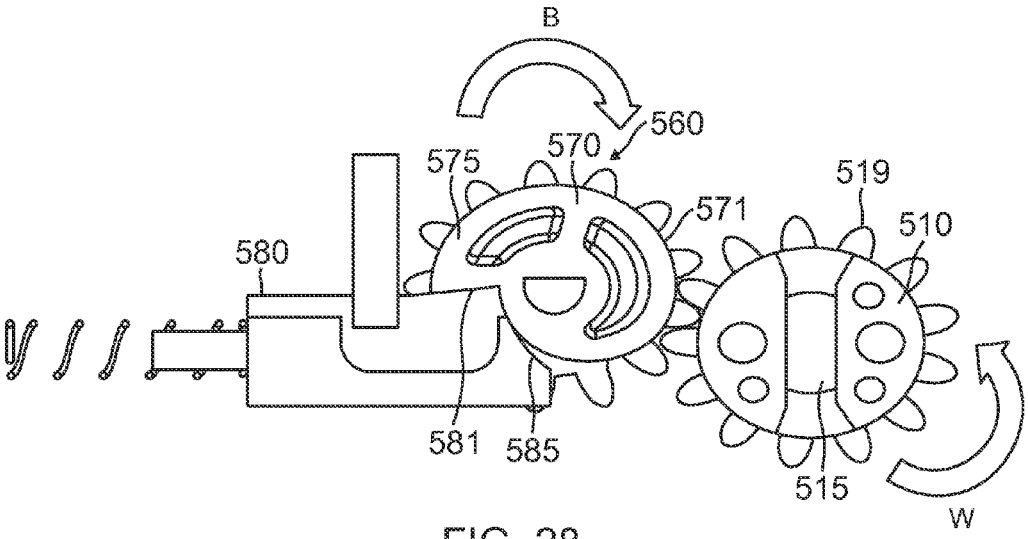

In some implementations, locking tabs 591 include a rear surface substantially perpendicular to the inserting direction of security gate mechanism preventing removal of security gate mechanism 500 from currency handling apparatus 10. Locking tabs 591 further include a forward surface that cause locking tabs 591 to be deflected inward of housing 501 when inserting security gate mechanism 500 into currency handling apparatus 10. When locking tabs 591 are deflecting inward by (for example) frame 800 during insertion of security gate mechanism 500, lock biasing member 595 is deformed, as seen in FIG. 24. In the illustrated example of FIGS. 25 and 26, during insertion of security gate mechanism 500 into currency handling mechanism 10, biasing spring 595 is compressed. Once security gate mechanism 500 is fully inserted into currency handling apparatus 10, locking mechanism 700 is able to cause locking arms 590 to extend outward from housing 501 and engage a locking recess in frame 800 (not shown).

As illustrated in the example of FIGS. 22-24 and 27-34, the security gate mechanism includes rotatable gate 510, having a slit 515 formed there through, and further includes drive wheel 560 operatively coupled to rotatable gate 510. In some implementations, drive wheel 560 is configured as a toothed gear for meshing engagement with rotatable gate 510. In other implementations, drive wheel 560 is coupled to rotatable gate 510 using a belt configuration or through rolling contact. In some implementations, drive wheel 560 can be further coupled to actuation assembly 58. In other implementations, drive wheel 560 is driven and controlled by a separate and independent actuator (e.g. a drive motor). Such an implementation allows for security gate mechanism 500 to be implemented at any position along passageway 300 for a desired application.

Rotatable gate 510 includes multiple flanges 511 configured to extend around the circumference of the gate. Each flange 511 is segmented to prevent obstruction of slit 515. In some configurations, some of the multiple flanges 511 are located outside the width of slit 515 and may not be segmented. In the illustrated example of FIGS. 33 and 34, rotatable gate 510 includes a sensing flange 513 having a predetermined segmentation 512 for operative coupling with sensing system 600.

Figure 35:
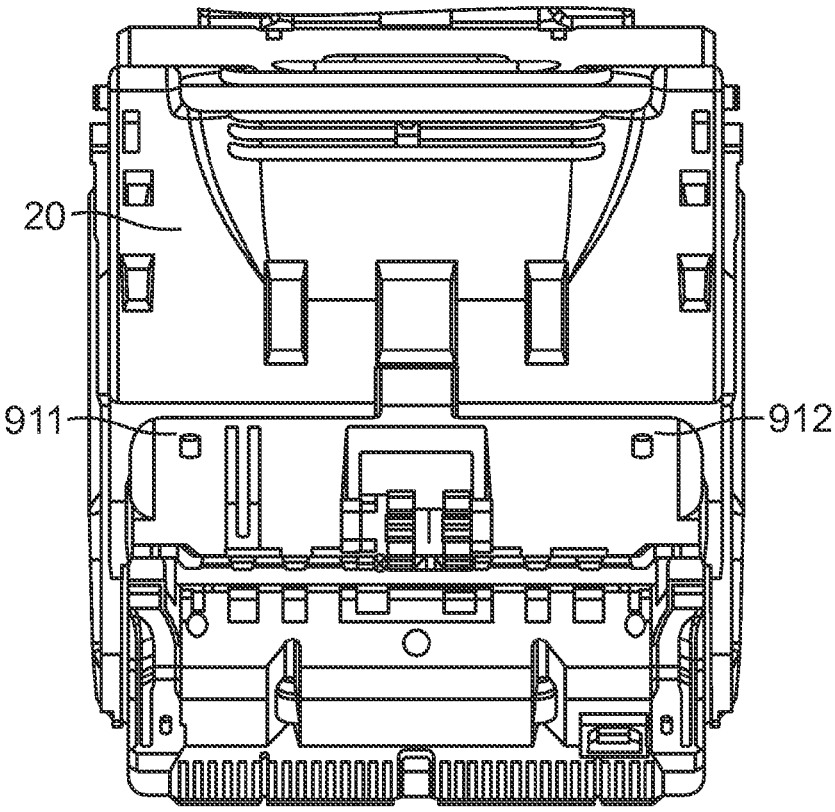
Figure 36:
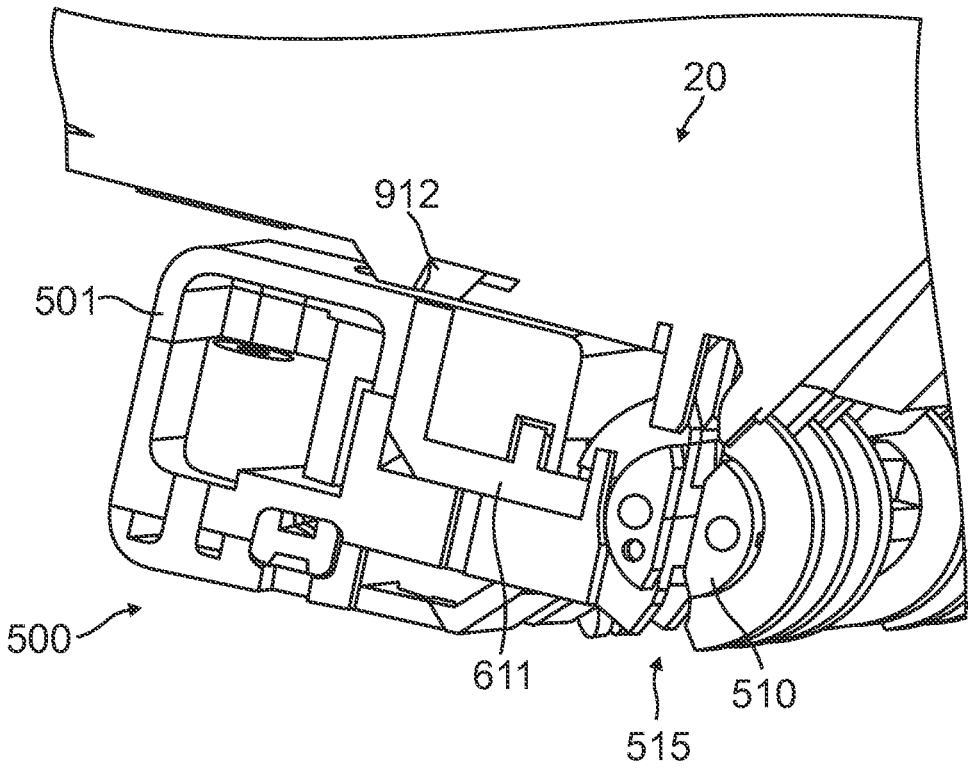

As illustrated in FIGS. 22-24 and 27-36, the security gate mechanism can include a position sensing system 600 for monitoring and determining the position of rotatable gate 510. In some implementations, rotatable gate 510 includes a sensing feature 110 on its periphery. As shown in the illustrated example, sensing system 600 includes a light pipes 611 and 612. Light pipe 611 includes a first end 621 configured to receive light from a light emitting component 911 and second end for transmitting the received light. Light pipe 612 includes a far end 622 configured for emitting received light to a light detector 912 of currency handling apparatus 10 and a second end for receiving light from light pipe 611 (see FIGS. 35 and 36).

In the example illustrated in FIGS. 28-32, the security gate mechanism further includes a positioning member 580 for selective engagement with drive wheel 560. In the illustrated example, drive wheel 560 includes a variable cam surface 570 and positioning abutment surface 575 operatively coupled with positioning member 580. Positioning member 580 includes a cam follower surface 585 and positioning member abutment surface 581. The positioning member 580 is biased in a direction towards variable cam surface 571 via biasing spring 582.

The operation of currency handling apparatus 10 and the security gate mechanism 500 is now described. An item of currency 5 is inserted into currency handling apparatus 10 at inlet 25 (see FIG. 1). The transportation mechanism (not shown) of validation module 20 transports currency item 5 past a sensing component (not shown) to determine the type and validity of currency item 5. Once a determination of validity of currency item 5 is made by validation module 20, the transportation mechanism of validation module 20 continues to transport currency item 5 along passageway 300, through slit 515 of rotatable gate 510. Once currency item 5 is located in a position adjacent stacking mechanism 50, stacking drive assembly 22 (see FIG. 3) is actuated to stack currency item 5 into storage unit 30 as will be described in more detail below.

Rotation of validator coupling gear 28 causes complementary rotation of coupling gear 569 due to the meshing engagement between the gears. Coupling gear 569, coaxial mounting on shaft 562 causes complimentary rotation of drive wheel 560 in direction B, which in turn causes rotation of rotatable gate 510 in a first rotational direction W. Rotation of rotatable gate 510 in first direction W is a result of meshing engagement of drive wheel 560 (rotating in direction B) with tooth gear portion 519 of rotatable gate 510.

Prior to passage of an item of currency 5 through slit 515 of security gate mechanism 500, drive wheel 560 and rotatable gate 510 are positioned in an initial position as shown in FIG. 16. In the initial position, positioning member 580 is positioned in a blocking position whereby positioning abutment surface 575 and positioning member abutment surface 581 are in abutment. As drive wheel 560 begins to rotate in direction B, complementary rotation of rotatable gate 510 occurs to rotate in direction W thereby moving positioning abutment surface 575 and positioning member abutment surface 581 out of abutment. Additionally, as drive wheel 560 rotates in direction B, positioning member 580 slides along cam surface 571 at cam follower surface 585. Movement of drive wheel 560 causes cam surface 571 to slide relative to cam follower surface 585. As a result of the variable radius of positioning cam surface 571, positioning member 580 begins to be displaced linearly relative to the rotational axis of drive wheel 560 and thus begins to move out of a blocking position. Movement of positioning member 580 from a blocking position to a non-blocking position compresses a biasing member 582.

Figure 18:
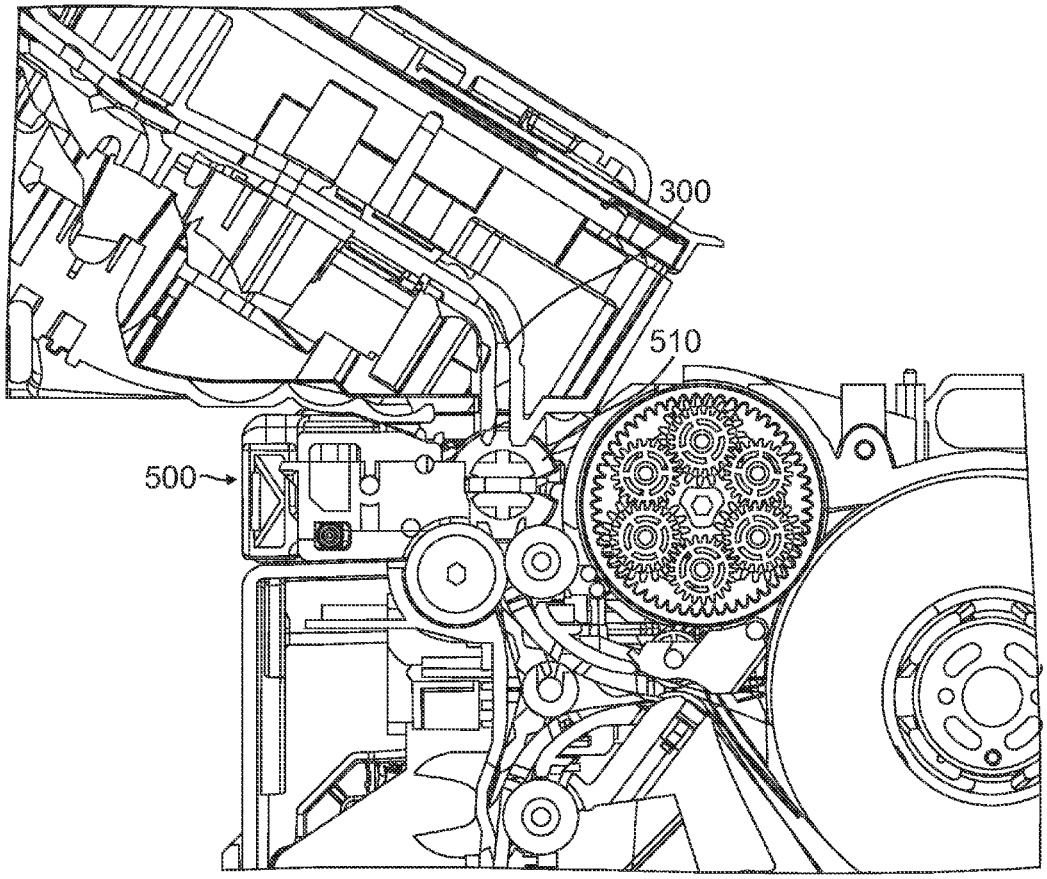

In conjunction with the rotation of drive wheel 560, the meshing engagement of drive wheel 560 causes gate 510 to rotate. Passage of an item of currency along passageway 300 and through slit 515, rotatable gate 510 is positioned in an initial position whereby slit 515 is aligned with passageway 300 such that an item of currency can pass there through. As drive wheel 560 causes rotation of rotatable gate 510 (see FIG. 29), slit 515 moves from an initial position allowing passage of a currency item, to a position whereby slit 515 is no longer aligned with passageway 300 (see FIG. 18).

In some implementations, drive wheel 560 is meshingly engaged with rotatable gate 510 having gear teeth arranged at a far end of the body of rotatable gate 510. In other implementations, as shown in the figures, the gear teeth of rotatable gate 510 are arranged within the body of rotatable gate 510 in a manner whereby slit 515 bisects the circumference of the toothed pattern of rotatable gate 510.

Figure 29:
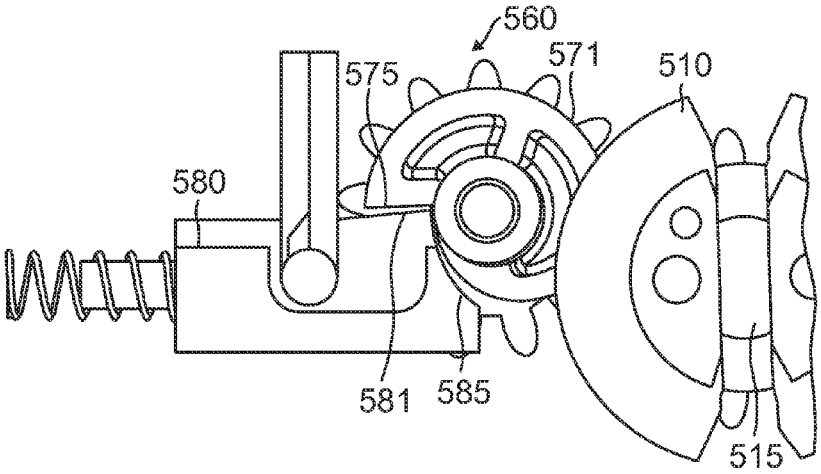
Figure 30:
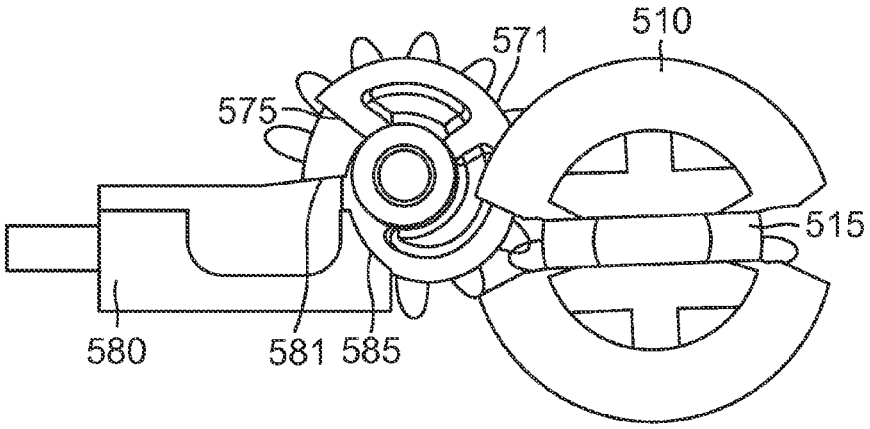
Figure 31:
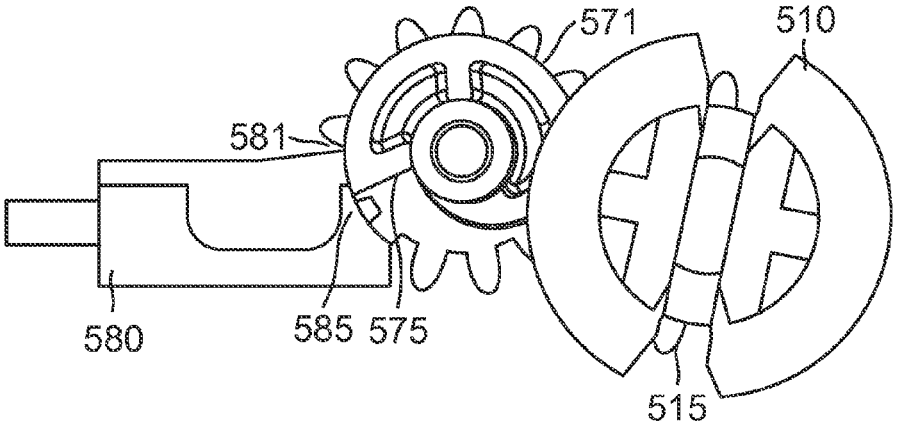
Figure 32:
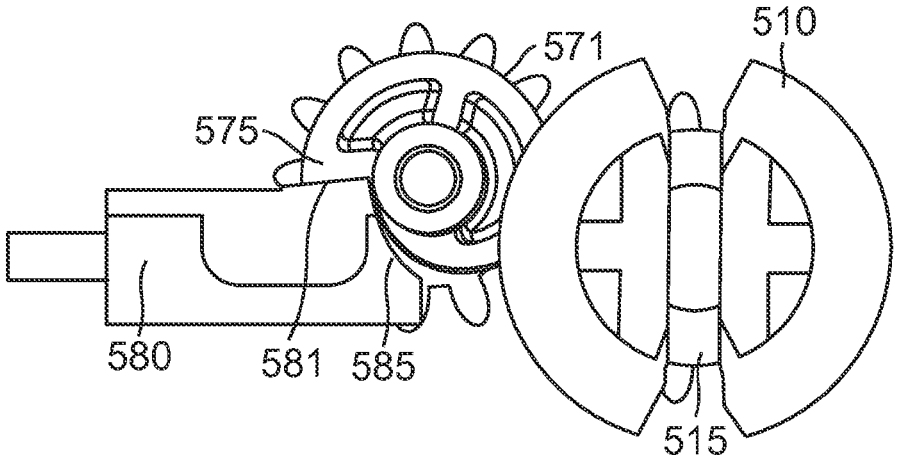

Continued actuation of coupling gear 28, and thus rotation of drive wheel 560, causes cam surface 571 to continue to slide past and along cam follower surface 585 and further displacing positioning member 580 from a blocking position. Because the security gate mechanism is operatively coupled to coupling gear 28, rotatable gate 510 will continue to rotate in the first direction as long as coupling gear is driven. As drive wheel 560 continues to rotate, positioning abutment surface 575 approaches positioning member abutment surface 581 as shown in FIG. 31. From this position continued rotation of drive wheel 560 causes positioning member 580 to return to a blocking position as shown in FIG. 32. Coupling gear 28 continues to rotate drive wheel 560 in direction B past the initial position allowing positioning member 580 to return to a blocking position. At this point coupling gear 28 is stopped from rotating drive wheel 560 in the first direction B resulting in a separation between positioning abutment surface 575 and positioning member abutment surface 581 as shown in FIG. 29.

To position rotatable gate 510 back into the initial position, coupling gear 28 is actuated in a reverse direction resulting in rotation of drive wheel 560 in a second direction C, which is opposite the first direction B. As a result of operating coupling gear 28 in a reverse direction, rotatable gate 510, via meshing engagement with drive wheel 560, also rotates in a second direction Z, opposite of the first direction W. Rotation of drive wheel 560 in a second direction Z causes positioning abutment surface 575 and positioning member abutment surface 581 to come into abutment at the initial position. Concurrently, due to the meshing engagement of rotatable gate 510 with driving gear 560, rotatable gate 510 also rotates in a second direction (i.e. reverse or opposite the first direction). Therefore once abutment between surfaces 575 and 581 is achieved, rotatable gate 510 has been returned to an initial position whereby slit 515 is again aligned with passageway 300.

Figure 33:
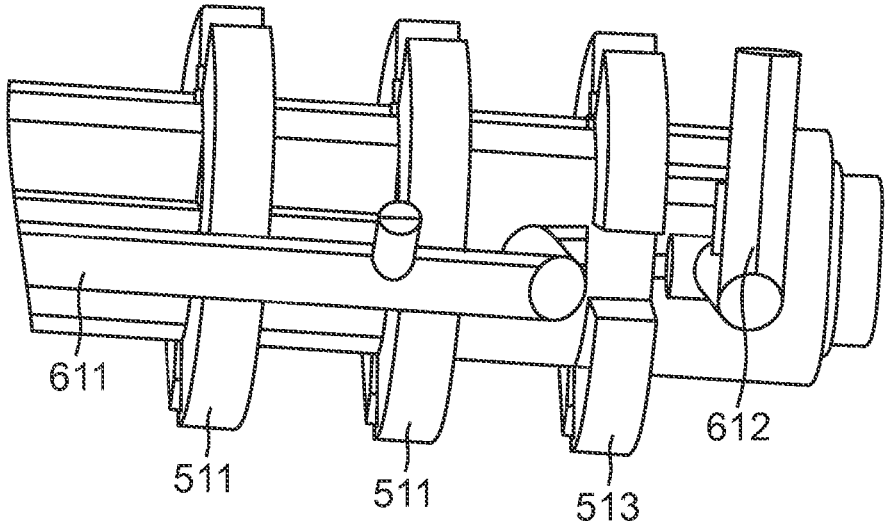
Figure 34:
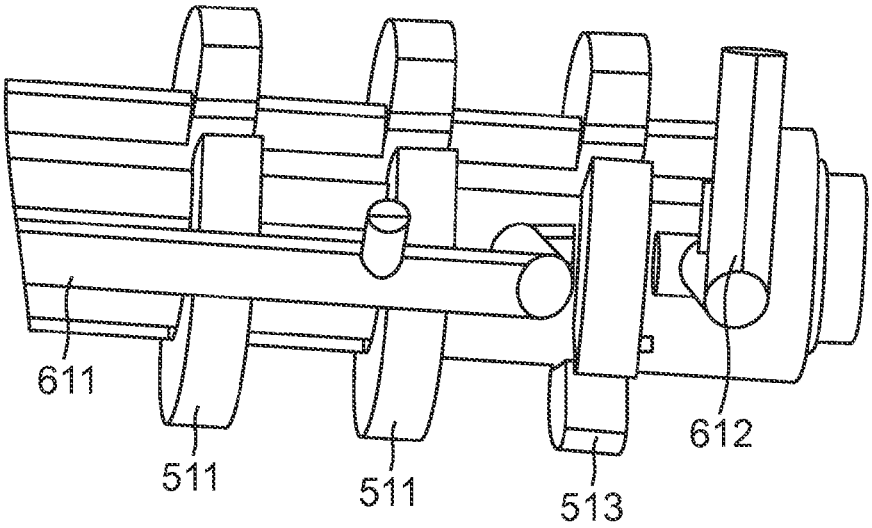

The operation of position sensing system 600 is described next. Starting from the initial position with rotatable gate 510 aligned with passageway 300, predetermined flange segmentation gap 512 is aligned with light pipes 611 and 612 so as to allow light to pass there between. As coupling gear 28 is actuated in a first direction B, rotatable gate 510 begins complementary rotation in a first direction. As rotatable gate 510 rotates, the predetermined segmentation gap 512 rotates away from light pipes 611 and 612 as shown in FIG. 33 and FIG. 34. Continued rotation of rotatable gate 510 results in flange 513 blocking light from passing between light pipes 611 and 612. In the illustrated example, position sensing system 600 monitors the light passed between light pipes 611 and 612 via detector 912. Sensing system 600 evaluates the pattern of light received and light blocked conditions as a result of the position of flange 513 relative to light pipes 611 and 612. More specifically, as rotatable gate 510 rotates through one complete rotation, position sensing system 600 will sense light passing between light pipes 611 and 612 (and thus received at detector 912) 3 times per full rotation. By configuring flange 513 with flange segmentation gap in a predetermined manner, monitoring the signal pattern received by detector 912 allows position sensing system 600 (or currency handling apparatus 10) to determine when rotatable gate 510 is located in the initial position and thus slit 515 being aligned with passageway 300.

In some implementations, during a extended actuation of coupling gear 28, position sensing system 600 may sense rotatable gate 510 becoming aligned with passageway 300 multiple times. The number of rotations rotatable gate 510 moves through depends on specific configurations (e.g. gear train ratios) of security gate mechanism 500.

In the forgoing implementations, the security gate mechanism has been described as an removable unit of currency handling apparatus 10, however the security gate mechanism can be configured as a retrofit unit operatively coupled to passageway 300 at any point to facilitate the prevention of a fraudulent attempt to remove an item of currency from currency handling apparatus 10. For example security gate mechanism can be configured to be driven by an actuator (not shown) operatively coupled to driving gear 560 and controlled separate from other transportation events of currency handling apparatus 10. An advantage of the disclosed security gate mechanism is that attempts to fraudulently remove a currency item 5 from handling apparatus 10 (e.g. by a string attached thereto) can be prevented by actuating drive gear 560 so as to rotate rotatable gate 510 resulting in any string attached to currency item 5 becoming wound around rotatable gate 510. If an attempt to remove a currency item 5 having a string attached thereto occurs, reverse rotation of rotatable gate 510 will be prevented by the abutment between positioning member 580 and drive wheel 560 as described herein.

In the implementations described above the position sensing system 600, the security gate mechanism 500, are all actuated simultaneously. In other implementations whereby the security gate mechanism can be actuated and controlled independently of other currency handling apparatus components,.

What is claimed is:

1. A security gate mechanism for a currency handling apparatus having a currency passageway comprising:

a housing; a rotatable gate having a slit therein and coupled to the housing, wherein the slit is aligned with the currency passageway when the rotatable gate is in an initial position;

a drive wheel coupled to the housing and further coupled to the rotatable gate, wherein the drive wheel is configured to drive the rotatable gate in first and second directions, the second direction being opposite the first direction;

a positioning member coupled to the housing and selectively engageable with the drive wheel for positioning the rotatable gate in the initial position such that the slit in the rotatable gate is substantially aligned with the currency passageway;

wherein the positioning member is configured to be engageable with the drive wheel for rotating the rotatable gate in the second direction and not engageable with the drive wheel when the drive wheel rotates the rotatable gate in the first direction.

2. The security gate mechanism according to claim 1 wherein the drive wheel is a toothed gear including a positioning cam surface thereon.

3. The security gate mechanism according to claim 1 wherein the positioning member is moved from a blocking position to a non-blocking position when the drive wheel is rotated in the first direction.

4. The security gate mechanism according to claim 1 wherein the positioning member further includes a positioning abutment surface.

5. The security gate mechanism according to claim 4 wherein the rotatable gate is positioned in the initial position when the positioning abutment surface and a positioning member abutment surface are in abutment.

6. The security gate mechanism according to claim 4 wherein the rotatable gate is positioned in the initial position by movement of the drive wheel in the second direction whereby the positioning abutment surface and a positioning member abutment surface are brought into abutment.

7. The security gate mechanism according to claim 1 wherein the drive wheel is coupled to a shaft mounted in the housing.

8. The security gate mechanism according to claim 7 wherein the shaft is mounted for rotation within the housing.

9. The security gate mechanism according to claim 1 wherein the drive wheel is integrally formed with a shaft mounted in the housing.

10. The security gate mechanism according to claim 9 wherein the shaft is mounted for rotation within the housing.

11. The security gate mechanism according to claim 1 wherein the rotatable gate further includes a plurality of substantially annular flanges around a circumference of the rotatable gate.

12. The security gate mechanism according to claim 11 wherein each of the plurality of flanges is segmented along its circumference defining a slot in alignment with the slit of the rotatable gate when in the initial position.

13. The security gate mechanism according to claim 1 wherein the rotatable gate further includes a toothed portion for meshing engagement with a toothed gear of the drive wheel.

14. The security gate mechanism according to claim 1 wherein the housing further includes a locking mechanism selectively engageable with the currency handling apparatus.

15. The security gate mechanism according to claim 1 further comprising a position sensing system.

16. The security gate mechanism according to claim 1 wherein the positioning member includes a cam follower surface for sliding engagement with a positioning cam surface of the drive wheel.

17. The security gate mechanism according to claim 1 wherein a positioning cam surface is a variable radius surface relative to a rotational axis of the drive wheel.

18. A removeable security gate mechanism for a currency handling apparatus having a currency passageway comprising:

a housing;

a rotatable gate having a slit therein and coupled to the housing, wherein the slit is aligned with the currency passageway when the rotatable gate is in an initial position;

a drive wheel coupled to the housing and further coupled to the rotatable gate, wherein the drive wheel is configured to drive the rotatable gate in first and second directions, the second direction being opposite the first direction;

a positioning member coupled to the housing and selectively engageable with the drive wheel for positioning the rotatable gate in the initial position such that the slit in the rotatable gate is substantially aligned with the currency passageway;

wherein the positioning member is configured to be engageable with the drive wheel for rotating the rotatable gate in the second direction and not engageable with the drive wheel when the drive wheel rotates the rotatable gate in the first direction.

19. A retrofit security gate mechanism for a currency handling apparatus having a currency passageway comprising:

a housing;

a rotatable gate having a slit therein and coupled to the housing, wherein the slit is aligned with the currency passageway when the rotatable gate is in an initial position;

a drive wheel coupled to the housing and further coupled to the rotatable gate, wherein the drive wheel is configured to drive the rotatable gate in first and second directions, the second direction being opposite the first direction;

a positioning member coupled to the housing and selectively engageable with the drive wheel for positioning the rotatable gate in the initial position such that the slit in the rotatable gate is substantially aligned with the currency passageway;

wherein the positioning member is configured to be engageable with the drive wheel for rotating the rotatable gate in the second direction and not engageable with the drive wheel when the drive wheel rotates the rotatable gate in the first direction.

* * * * *